US009190777B2

(12) United States Patent
Larsen et al.

(10) Patent No.: US 9,190,777 B2
(45) Date of Patent: Nov. 17, 2015

(54) COMMUNICATIONS PLUGS HAVING CAPACITORS THAT INJECT OFFENDING CROSSTALK AFTER A PLUG-JACK MATING POINT AND RELATED CONNECTORS AND METHODS

(71) Applicant: CommScope, Inc. of North Carolina, Hickory, NC (US)

(72) Inventors: Wayne D. Larsen, Wylie, TX (US); Bryan Moffitt, Red Bank, NJ (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 14/198,821

(22) Filed: Mar. 6, 2014

(65) Prior Publication Data

US 2014/0187090 A1 Jul. 3, 2014

Related U.S. Application Data

(63) Continuation of application No. 13/471,590, filed on May 15, 2012, now Pat. No. 8,696,386, which is a continuation of application No. 12/795,843, filed on Jun. 8, 2010, now Pat. No. 8,197,286.

(60) Provisional application No. 61/186,061, filed on Jun. 11, 2009.

(51) Int. Cl.
*H01R 13/66* (2006.01)
*H01R 13/6461* (2011.01)
(Continued)

(52) U.S. Cl.
CPC ..... *H01R 13/6461* (2013.01); *H01R 4/2429* (2013.01); *H01R 13/506* (2013.01);
(Continued)

(58) Field of Classification Search
CPC ..... H01R 13/6461; H01R 13/6464; H01R 13/5833; H01R 13/6625; H01R 13/506; H01R 13/6658; H01R 4/2429; H01R 24/64; Y10S 439/941
USPC ..... 439/620.21, 941, 676, 76.1, 620.22, 439/620.23, 418, 403, 404
See application file for complete search history.

(56) References Cited

U.S. PATENT DOCUMENTS 5,967,801 A 10/1999 Martin et al.
5,967,828 A 10/1999 Geurts et al.
(Continued)

FOREIGN PATENT DOCUMENTS

CN 1184565 A 6/1998
DE 102006010279 A1 9/2007
WO WO 96/37015 11/1996

OTHER PUBLICATIONS

OptolIQ.com Datasheet for Telegartner Shielded Cat 6 RJ-45 Plug printed Apr. 21, 2009.
(Continued)

*Primary Examiner* — Javaid Nasri
(74) *Attorney, Agent, or Firm* — Myers Bigel Sibley & Sajovec, P.A.

(57) ABSTRACT

Communications plugs are provided that include a plug housing. A plurality of plug contacts are mounted in a row at least partly within the plug housing. The plug contacts are arranged as differential pairs of plug contacts. Each of the differential pairs of plug contacts has a tip plug contact and a ring plug contact. A first capacitor is provided that is configured to inject crosstalk from a first of the tip plug contacts to a first of the ring plug contacts at a point in time that is after the point in time when a signal transmitted through the first of the tip plug contacts to a contact of a mating jack reaches the contact of the mating jack.

18 Claims, 23 Drawing Sheets

(51) Int. Cl.

| | |
|---|---|
| ***H01R 4/24*** | (2006.01) |
| ***H01R 13/506*** | (2006.01) |
| ***H01R 13/58*** | (2006.01) |
| ***H01R 13/6464*** | (2011.01) |
| *H01R 24/64* | (2011.01) |

(52) U.S. Cl.
CPC ..... *H01R13/5833* (2013.01); *H01R 13/6464* (2013.01); *H01R 13/6625* (2013.01); *H01R 13/6658* (2013.01); *H01R 24/64* (2013.01); *Y10S 439/941* (2013.01)

(56) References Cited

U.S. PATENT DOCUMENTS

| | | | | |
|---|---|---|---|---|
| 5,997,358 | A | 12/1999 | Adriaenssens et al. | |
| 6,139,371 | A | 10/2000 | Troutman et al. | |
| 6,165,023 | A | 12/2000 | Troutman et al. | |
| 6,244,906 | B1 | 6/2001 | Hashim et al. | |
| 6,276,954 | B1 | 8/2001 | Arnett et al. | |
| 6,283,768 | B1 | 9/2001 | Van Naarden | |
| 6,350,158 | B1 | 2/2002 | Arnett et al. | |
| 6,409,547 | B1 | 6/2002 | Reede | |
| 6,443,777 | B1 | 9/2002 | McCurdy et al. | |
| 7,201,618 | B2 | 4/2007 | Ellis et al. | |
| 7,229,309 | B2 | 6/2007 | Carroll | |
| 7,335,066 | B2 | 2/2008 | Carroll | |
| 7,427,218 | B1 | 9/2008 | Hashim et al. | |
| 7,604,515 | B2 | 10/2009 | Siemon et al. | |
| 7,874,849 | B2 * | 1/2011 | Sticker et al. | 439/76.1 |
| 7,980,899 | B2 | 7/2011 | Siemon et al. | |
| 2008/0007372 | A1 | 1/2008 | Carroll | |
| 2008/0188138 | A1 | 8/2008 | Carroll et al. | |
| 2008/0268719 | A1 | 10/2008 | Siemon et al. | |
| 2008/0311797 | A1 | 12/2008 | Aekins | |
| 2009/0142968 | A1 | 6/2009 | Goodrich et al. | |
| 2010/0003863 | A1 | 1/2010 | Siemon et al. | |

OTHER PUBLICATIONS

Notification of Transmittal of the International Search Report and the Written Opinino of the International Searching Authority, or the Declaration, International Search Report, Written Opinion of the International Searching Authority, PCT/US210/038159, Date of mailing: Aug. 27, 2010, 14 pages.

International Preliminary Report on Patentability Corresponding to International Application No. PCT/US2010/038159; Date of Mailing: Aug. 18, 2011, 8 pages.

Chinese Office Action with translation for Chinese Patent App. No. 2010800257612, dated Sep. 26, 2013.

* cited by examiner

COMMUNICATIONS PLUGS HAVING CAPACITORS THAT INJECT OFFENDING CROSSTALK AFTER A PLUG-JACK MATING POINT AND RELATED CONNECTORS AND METHODS

CLAIM OF PRIORITY

The present application claims priority under 35 U.S.C. §120 as a continuation of U.S. patent application Ser. No. 13/471,590, filed May 15, 2012 and issued as U.S. Pat. No. 8,696,386, which in turn claims priority under 35 U.S.C. §120 as a continuation of U.S. patent application Ser. No. 12/795,843, filed Jun. 8, 2010 and issued as U.S. Pat. No. 8,197,286, which in turn claims priority under 35 U.S.C. §119(e) from U.S. Provisional Patent Application Ser. No. 61/186,061, filed Jun. 11, 2009, entitled COMMUNICATIONS PLUGS HAVING CAPACITORS THAT INJECT OFFENDING CROSSTALK AFTER A PLUG-JACK MATING POINT AND RELATED CONNECTORS AND METHODS. The disclosure of each of the above-referenced applications is hereby incorporated herein by reference.

FIELD OF THE INVENTION

The present invention relates generally to communications connectors and, more particularly, to communications connectors that may exhibit reduced crosstalk over a wide frequency range.

BACKGROUND

Computers, fax machines, printers and other electronic devices are routinely connected by communications cables to network equipment and/or to external networks such as the Internet. FIG. 1 illustrates the manner in which a computer 10 may be connected to network equipment 20 using conventional communications plug/jack connections. As shown in FIG. 1, the computer 10 is connected by a patch cord assembly 11 to a communications jack 30 that is mounted in a wall plate 19. The patch cord assembly 11 comprises a communications cable 12 that contains a plurality of individual conductors (e.g., insulated copper wires) and two communications plugs 13, 14 that are attached to the respective ends of the cable 12. The communications plug 13 is inserted into a communications jack (not pictured in FIG. 1) that is provided in the computer 10, and the communications plug 14 inserts into a plug aperture 32 in the front side of the communications jack 30. The plug contacts (which are commonly referred to as "blades") of communications plug 14 (which are exposed through the slots 15 on the top and front surfaces of communications plug 14) mate with respective contacts (not visible in FIG. 1) of the communications jack 30 when the communications plug 14 is inserted into the plug aperture 32. The blades of communications plug 13 similarly mate with respective contacts of the communications jack (not pictured in FIG. 1) that is provided in the computer 10.

The communications jack 30 includes a back-end connection assembly 50 that receives and holds conductors from a cable 60. As shown in FIG. 1, each conductor of cable 60 is individually pressed into a respective one of a plurality of slots provided in the back-end connection assembly 50 to establish mechanical and electrical connection between each conductor of cable 60 and the communications jack 30. The other end of each conductor in cable 60 may be connected to, for example, the network equipment 20. The wall plate 19 is typically mounted on a wall (not shown) of a room or office of, for example, an office building, and the cable 60 typically runs through conduits in the walls and/or ceilings of the building to a room in which the network equipment 20 is located. The patch cord assembly 11, the communications jack 30 and the cable 60 provide a plurality of signal transmission paths over which information signals may be communicated between the computer 10 and the network equipment 20. It will be appreciated that typically one or more patch panels or switches, along with additional communications cabling, would be included in the electrical path between the cable 60 and the network equipment 20. However, for ease of description, these additional elements have been omitted from FIG. 1 and the cable 60 is instead shown as being directly connected to the network equipment 20.

In many electrical communications systems that are used to interconnect computers, network equipment, printers and the like, the information signals are transmitted between devices over a pair of conductors (hereinafter a "differential pair" or simply a "pair") rather than over a single conductor. The signals transmitted on each conductor of the differential pair have equal magnitudes, but opposite phases, and the information signal is embedded as the voltage difference between the signals carried on the two conductors of the pair. When signals are transmitted over a conductor (e.g., an insulated copper wire) in a communications cable, electrical noise from external sources such as lightning, electronic equipment, radio stations, etc. may be picked up by the conductor, degrading the quality of the signal carried by the conductor. When the signal is transmitted over a differential pair of conductors, each conductor in the differential pair often picks up approximately the same amount of noise from these external sources. Because approximately an equal amount of noise is added to the signals carried by both conductors of the differential pair, the information signal is typically not disturbed, as the information signal is extracted by taking the difference of the signals carried on the two conductors of the differential pair; thus, the noise signal is cancelled out by the subtraction process.

The cables and connectors in many, if not most, high speed communications systems include eight conductors that are arranged as four differential pairs. Channels are formed by cascading plugs, jacks and cable segments to provide connectivity between two end devices. In these channels, when a plug mates with a jack, the proximities and routings of the conductors and contacting structures within the jack and/or plug can produce capacitive and/or inductive couplings. Moreover, since four differential pairs are usually bundled together in a single cable, additional capacitive and/or inductive coupling may occur between the differential pairs within each cable. These capacitive and inductive couplings in the connectors and cabling give rise to another type of noise that is called "crosstalk."

"Crosstalk" in a communication system refers to unwanted signal energy that is induced onto the conductors of a first "victim" differential pair from a signal that is transmitted over a second "disturbing" differential pair. The induced crosstalk may include both near-end crosstalk (NEXT), which is the crosstalk measured at an input location corresponding to a source at the same location (i.e., crosstalk whose induced voltage signal travels in an opposite direction to that of an originating, disturbing signal in a different path), and far-end crosstalk (FEXT), which is the crosstalk measured at the output location corresponding to a source at the input location (i.e., crosstalk whose signal travels in the same direction as the disturbing signal in the different path). Both types of crosstalk comprise an undesirable noise signal that interferes with the information signal on the victim differential pair.

A variety of techniques may be used to reduce crosstalk in communications systems such as, for example, tightly twisting the paired conductors in a cable, whereby different pairs are twisted at different rates that are not harmonically related, so that each conductor in the cable picks up approximately equal amounts of signal energy from the two conductors of each of the other differential pairs included in the cable. If this condition can be maintained, then the crosstalk noise may be significantly reduced, as the conductors of each differential pair carry equal magnitude, but opposite phase signals such that the crosstalk added by the two conductors of a differential pair onto the other conductors in the cable tends to cancel out.

While such twisting of the conductors and/or various other known techniques may substantially reduce crosstalk in cables, most communications systems include both cables and communications connectors (i.e., jacks, plugs and connecting blocks, etc.) that interconnect the cables and/or connect the cables to computer hardware. Unfortunately, the connector configurations that were adopted years ago generally did not maintain the conductors of each differential pair a uniform distance from the conductors of the other differential pairs in the connector hardware. Moreover, in order to maintain backward compatibility with connector hardware that is already installed, the connector configurations have, for the most part, not been changed. As such, the conductors of each differential pair tend to induce unequal amounts of crosstalk on each of the other conductor pairs in current and pre-existing connectors. As a result, many current connector designs generally introduce some amount of NEXT and FEXT crosstalk.

Pursuant to certain industry standards (e.g., the TIA/EIA-568-B.2-1 standard approved Jun. 20, 2002 by the Telecommunications Industry Association), each jack, plug and cable segment in a communications system may include a total of eight conductors 1-8 that comprise four differential pairs. The industry standards specify that, in at least the connection region where the contacts (blades) of a modular plug mate with the contacts of the modular jack (referred to herein as the "plug jack mating region"), the eight conductors are aligned in a row, with the four differential pairs specified as depicted in FIG. 2. As known to those of skill in the art, under the TIA/EIA 568 type B configuration, conductors 4 and 5 in FIG. 2 comprise pair 1, conductors 1 and 2 comprise pair 2, conductors 3 and 6 comprise pair 3, and conductors 7 and 8 comprise pair 4. As known to those of skill in the art, conductors 1, 3, 5 and 7 comprise "tip" conductors, and conductors 2, 4, 6 and 8 comprise "ring" conductors.

As shown in FIG. 2, in the plug-jack mating region, the conductors of the differential pairs are not equidistant from the conductors of the other differential pairs. By way of example, conductors 1 and 2 of pair 2 are different distances from conductor 3 of pair 3. Consequently, differential capacitive and/or inductive coupling occurs between the conductors of pairs 2 and 3 that generate both NEXT and FEXT. Similar differential coupling occurs with respect to the other differential pairs in the modular plug and the modular jack. This differential coupling typically occurs in the blades of the modular plugs and in at least a portion of the contacts of the modular jack.

As the operating frequencies of communications systems increased, crosstalk in the plug and jack connectors became a more significant problem. To address this problem, communications jacks were developed that included compensating crosstalk circuits that introduced compensating crosstalk that was used to cancel much of the "offending" crosstalk that was being introduced in the plug-jack mating region. In particular, in order to cancel the "offending" crosstalk that is generated in a plug-jack connector because a first conductor of a first differential pair inductively and/or capacitively couples more heavily with a first of the two conductors of a second differential pair than does the second conductor of the first differential pair, jacks were designed so that the second conductor of the first differential pair would capacitively and/or inductively couple with the first of the two conductors of the second differential pair later in the jack to provide a "compensating" crosstalk signal. As the first and second conductors of the differential pair carry equal magnitude, but opposite phase signals, so long as the magnitude of the "compensating" crosstalk signal that is induced in such a fashion is equal to the magnitude of the "offending" crosstalk signal, then the compensating crosstalk signal that is introduced later in the jack may substantially cancel out the offending crosstalk signal.

FIG. 3 is a schematic diagram of a plug-jack connector 60 (i.e., an RJ-45 communications plug 70 that is mated with an RJ-45 communications jack 80) that illustrate how the above-described crosstalk compensation scheme may work. As shown by the arrow in FIG. 3 (which represents the time axis for a signal flowing from the plug 70 to the jack 80), crosstalk having a first polarity (here arbitrarily shown by the "+" sign as having a positive polarity) is induced from the conductor(s) of a first differential pair onto the conductor(s) of a second differential pair. By way of example, when a signal is transmitted on pair 3 of plug 70, in both the plug 70 and in the plug-jack mating region portion of the jack 80, the signal on conductor 3 of pair 3 will induce a larger amount of current onto conductor 4 of pair 1 than conductor 6 of pair 3 will induce onto conductor 4 of pair 1, thereby resulting in an "offending" crosstalk signal on pair 1. By arranging the conductive paths in a later part of the jack 80 to include a capacitor between, for example, conductors 3 and 5 and/or to have inductive coupling between conductors 3 and 5, it is possible to introduce one or more "compensating" crosstalk signals in the jack 80 that will at least partially cancel the offending crosstalk signal on pair 1. An alternative method for generating such a compensating crosstalk signal would be to design the jack 80 to provide capacitive and/or inductive coupling between conductors 4 and 6, as the signal carried by conductor 6 has a polarity that is opposite the signal carried by conductor 3.

While the simplified example of FIG. 3 discusses methods of providing compensating crosstalk that cancels out the differential crosstalk induced from conductor 3 to conductor 4 (i.e., part of the pair 3 to pair 1 crosstalk), it will be appreciated that the industry standardized connector configurations result in offending crosstalk between various of the differential pairs, and compensating crosstalk circuits are typically provided in the jack for reducing the offending crosstalk between more than one pair combination.

FIG. 4 is a schematic graph that illustrates the offending crosstalk signal and the compensating crosstalk signal that are discussed above with respect to FIG. 3 as a function of time. In the plug blades and in the plug-jack mating region of the jack, the offending crosstalk signal that is discussed in the example above is the signal energy induced from conductor 3 onto conductor 4 minus the signal energy induced from conductor 6 onto conductor 4. This offending crosstalk is represented by vector $A_0$ in FIG. 4, where the length of the vector represents the magnitude of the crosstalk and the direction of the vector (up or down) represents the polarity (positive or negative) of the crosstalk. It will be appreciated that the offending crosstalk will typically be distributed to some extent over the time axis, as the differential coupling typically starts at the point where the wires of the cable (e.g., conductors 3-6) are untwisted and continues through the plug blades and into the jack contact region of the jack 80 (and perhaps even further into the jack 80). However, for ease of description, this distributed crosstalk is represented as a single crosstalk vector $A_0$ having a magnitude equal to the sum of the distributed crosstalk that is located at the weighted midpoint of the differential coupling region (referred to herein as a "lumped approximation").

As is further shown in FIG. 4, the compensating crosstalk circuit in the jack 80 (e.g., a capacitor between conductors 4 and 6) induces a second crosstalk signal onto pair 1 which is represented by the vector $A_1$ in FIG. 4. As the crosstalk compensation circuit is located after the jackwire contacts (with respect to a signal travelling in the forward direction from the plug 70 to the jack 80), the compensating crosstalk vector $A_1$ is located farther to the right on the time axis. The compensating crosstalk vector $A_1$ has a polarity that is opposite to the polarity of the offending crosstalk vector $A_0$ as conductors 3 and 6 carry opposite phase signals.

The signals carried on the conductors are alternating current signals, and hence the phase of the signal changes with time. As the compensating crosstalk circuit is typically located quite close to the plug-jack mating region (e.g., less than an inch away), the time difference (delay) between the offending crosstalk region and the compensating crosstalk circuit is quite small, and hence the change in phase likewise is small for low frequency signals. As such, the compensating crosstalk signal can be designed to almost exactly cancel out the offending crosstalk with respect to low frequency signals (e.g., signals having a frequency less than 100 MHz).

However, for higher frequency signals, the phase change between vectors $A_0$ and $A_1$ can become significant. Moreover, in order to meet the increasing throughput requirements of modern computer systems, there is an ever increasing demand for higher frequency connections. FIG. 5A is a vector diagram that illustrates how the phase of compensating crosstalk vector $A_1$ will change by an angle $\phi$ due to the time delay between vectors $A_0$ and $A_1$. As a result of this phase change $\phi$, vector $A_1$ is no longer offset from vector $A_0$ by 180°, but instead is offset by 180°-$\phi$. Consequently, compensating crosstalk vector $A_1$ will not completely cancel the offending crosstalk vector $A_0$. This can be seen graphically in FIG. 5B, which illustrates how the addition of vectors $A_0$ and $A_1$ still leaves a residual crosstalk vector. FIG. 5B also makes clear that the degree of cancellation decreases as cp gets larger. Thus, due to the increased phase change at higher frequencies, the above-described crosstalk compensation scheme cannot fully compensate for the offending crosstalk.

U.S. Pat. No. 5,997,358 to Adriaenssens et al. (hereinafter "the '358 patent") describes multi-stage crosstalk compensating schemes for plug-jack connectors that can be used to provide significantly improved crosstalk cancellation, particularly at higher frequencies. The entire contents of the '358 patent are hereby incorporated herein by reference as if set forth fully herein. Pursuant to the teachings of the '358 patent, two or more stages of compensating crosstalk are added, usually in the jack, that together reduce or substantially cancel the offending crosstalk at the frequencies of interest. The compensating crosstalk can be designed, for example, into the lead frame wires of the jack and/or into a printed wiring board that is electrically connected to the lead frame.

As discussed in the '358 patent, the magnitude and phase of the compensating crosstalk signal(s) induced by each stage are selected so that, when combined with the compensating crosstalk signals from the other stages, they provide a composite compensating crosstalk signal that substantially cancels the offending crosstalk signal over a frequency range of interest. In embodiments of these multi-stage compensation schemes, the first compensating crosstalk stage (which can include multiple sub-stages) has a polarity that is opposite the polarity of the offending crosstalk, while the second compensating crosstalk stage has a polarity that is the same as the polarity of the offending crosstalk.

FIG. 6A is a schematic graph of crosstalk versus time that illustrates the location of the offending and compensating crosstalk (depicted as lumped approximations) if the jack of FIG. 3 is modified to implement multi-stage compensation. As shown in FIG. 6A, the offending crosstalk signal that is induced in the plug and in the plug-jack mating region can be represented by the vector $B_0$ which has a magnitude equal to the sum of the distributed offending crosstalk and which is located at the weighted midpoint of the coupling region where the offending crosstalk is induced. As is further shown in FIG. 6A, the compensating crosstalk circuit in the jack induces a second crosstalk signal which is represented by the vector $B_1$. As the crosstalk compensation circuit is located after the jackwire contacts (with respect to a signal travelling in the forward direction), the compensating crosstalk vector $B_1$ is located farther to the right on the time axis. The compensating crosstalk vector $B_1$ has a polarity that is opposite to the polarity of the offending crosstalk vector $B_0$. Moreover, the magnitude of the compensating crosstalk vector $B_1$ is larger than the magnitude of the offending crosstalk vector $B_0$. Finally, a second compensating crosstalk vector $B_2$ is provided that is located even farther to the right on the time axis. The compensating crosstalk vector $B_2$ has a polarity that is opposite the polarity of crosstalk vector $B_1$, and hence that is the same as the polarity of the offending crosstalk vector $B_0$.

FIG. 6B is a vector summation diagram that illustrates how the multi-stage compensation crosstalk vectors $B_1$ and $B_2$ of FIG. 6A can cancel the offending crosstalk vector $B_0$ at a selected frequency. FIG. 6B takes the crosstalk vectors from FIG. 6A and plots them on a vector diagram that visually illustrates the magnitude and phase of each crosstalk vector. In FIG. 6B, the dotted line versions of vectors $B_1$ and $B_2$ are provided to show how the three vectors $B_0$, $B_1$ and $B_2$ may be designed to sum to approximately zero at a selected frequency. In particular, as shown in FIG. 6B, the first compensating crosstalk stage ($B_1$) significantly overcompensates the offending crosstalk. The second compensating crosstalk stage ($B_2$) is then used to bring the sum of the crosstalk back to the origin of the graph (indicating substantially complete cancellation at the selected frequency). The multi-stage (i.e., two or more) compensation schemes disclosed in the '358 patent thus can be more efficient at reducing the NEXT than schemes in which the compensation is added at a single stage.

The first compensating stage can be placed in a variety of locations. U.S. Pat. Nos. 6,350,158; 6,165,023; 6,139,371; 6,443,777 and 6,409,547 disclose communications jacks having crosstalk compensation circuits implemented on or connected to the free ends of the jackwire contacts, The '358 patent discloses communications jacks having crosstalk compensation circuits implemented on a printed circuit board that are connected to the mounted ends of the jackwire contacts.

SUMMARY

Pursuant to embodiments of the present invention, communications plugs are provided that include a plug housing. A plurality of plug contacts are mounted in a row at least partly within the plug housing. The plug contacts are arranged as differential pairs of plug contacts. Each of the differential pairs of plug contacts has a tip plug contact and a ring plug contact. A first capacitor is provided that is configured to inject crosstalk from a first of the tip plug contacts to a first of the ring plug contacts at a point in time that is after the point in time when a signal transmitted through the first of the tip plug contacts to a contact of a mating jack reaches the contact of the mating jack.

In some embodiments, the first capacitor may be separate from the first of the tip plug contacts and the first of the ring plug contacts, and a first electrode of the first capacitor is coupled to a non-signal current carrying portion of the first of the tip plug contacts and a second electrode of the first capacitor is coupled to a non-signal current carrying portion of the first of the ring plug contacts. The first of the tip plug contacts and the first of the ring plug contacts may be mounted directly adjacent to each other in the housing and may belong to different of the plurality of differential pairs of plug contacts. In some embodiments, the plug contacts may be mounted on a printed circuit board (e.g., as skeletal plug blades), and the first capacitor may be implemented within the printed circuit board.

In some embodiments where the plug includes a printed circuit board, a total of eight plug contacts may be provided (i.e., four differential pairs). Each plug contact may include respective first and second ends that are mounted in the printed circuit board with the first end of each plug contact being closer to a front edge of the printed circuit board than is the second end of each plug contact. In such embodiments, each of the plug contacts may have a respective signal current carrying path that extends from the second end of each plug contact to a plug-jack mating point of the plug contact. In other embodiments, each of the plug contacts may have a respective signal current carrying path that extends from the first end of each plug contact to a plug-jack mating point of the plug contact. In still other embodiments, a first of the plug contacts of each differential pair has a respective signal current carrying path that extends from the second end of each plug contact to a plug-jack mating point of the plug contact, and a second of the plug contacts of each differential pair has a respective signal current carrying path that extends from the first end of each plug contact to a plug-jack mating point of the plug contact. In some embodiments, each plug blade includes a projection, and the projections on adjacent plug blades may extend in different directions.

In some embodiments, the first capacitor may be connected to the non-signal current carrying portion of the first of the tip plug contacts by a conductive element that is not part of the first of the plug contacts. Moreover, in some cases, the first capacitor may generate at least 75% of the capacitive crosstalk between the first of the tip plug contacts and the first of the ring plug contacts. The above-discussed plugs may be attached to an end of a communications cable that has a plurality of conductors to provide a patch cord.

In certain embodiments, a first electrode of the first capacitor may be a first plate-like extension that is part of a non-signal current carrying portion of the first of the tip plug contacts and a second electrode of the first capacitor may comprise a second plate-like extension that is part of a non-signal current carrying portion of the first of the ring plug contacts. In other embodiments, a first electrode of the first capacitor may be coupled to a non-signal current carrying portion of the first of the tip plug contacts and a second electrode of the first capacitor may be coupled to a signal current carrying portion of the first of the ring plug contacts.

Pursuant to further embodiments of the present invention, communications plugs are provided that include a plug housing and a plurality of plug contacts that are mounted in a row at least partly within the plug housing. The plug contacts are arranged as a plurality of differential pairs of tip and ring plug contacts. These plugs include a first capacitor that has a first electrode that is connected to a plug-jack mating point of a first of the tip plug contacts by a first substantially non-signal current carrying conductive path and a second electrode that is connected to a plug-jack mating point of a first of the ring plug contacts by a second substantially non-signal current carrying conductive path. The first tip plug contact and the first ring plug contact are part of different ones of the plurality of differential pairs of plug contacts.

In some embodiments, the first tip plug contact and the first ring plug contact are mounted next to each other in the row. The first capacitor may be formed within a printed circuit board. In some cases, the first tip plug contact may be a skeletal plug contact having a first end mounted in the printed circuit board that is directly connected to a first wire connection terminal that is mounted in the printed circuit board by a first conductive path through the printed circuit board, a central portion, at least part of which is configured to engage a contact of a mating jack, and a second end that is opposite the first end. The second end of the first tip plug contact may be directly connected to the first electrode of the first discrete capacitor by the first substantially non-signal current carrying conductive path, Pursuant to further embodiments of the present invention, methods of reducing the crosstalk generated in a communications connector are provided. The connector comprises a plug having eight plug contacts that are mated at a plug-jack mating point with respective ones of eight jack contacts of a mating jack, each of the eight mated sets of plug and jack contacts being part of a respective one of eight conductive paths through the connector that are arranged as first through fourth differential pairs of conductive paths. Pursuant to these methods, a plug capacitor is provided between one of the conductive paths of the first differential pair of conductive paths and one of the conductive paths of the second differential pair of conductive paths. This plug capacitor is configured to inject crosstalk between the first and second differential pairs of conductive paths at a point in time that is after the point in time when a signal transmitted over the first differential pair of conductive paths in either the direction from the plug to the jack, or the direction from the jack to the plug, reaches the plug-jack mating point.

In some embodiments, a jack capacitor may also be provided between one of the conductive paths of the first differential pair of conductive paths and one of the conductive paths of the second differential pair of conductive paths. The jack capacitor may be configured to inject crosstalk between the first and second differential pairs of conductive paths at a point in time that is after the plug-jack mating point when a signal is transmitted over the first differential pair of conductive paths in either the direction from the plug to the jack or the direction from the jack to the plug. In such embodiments, the plug capacitor and the jack capacitor may inject the crosstalk at substantially the same point in time when a signal is transmitted in the direction from the plug to the jack. The plug capacitor may inject crosstalk having a first polarity and the jack capacitor may inject crosstalk having a second polarity that is opposite the first polarity.

In some embodiments, the plug capacitor may be a discrete capacitor that is separate from the plug contacts that couples energy between the conductive paths associated with a first of the plug contacts and a second of the plug contacts that are next to each other. An electrode of the plug capacitor may be directly connected by a non-signal current carrying path to a non-signal current carrying portion of the first of the plug contacts.

Pursuant to still further embodiments of the present invention, methods of reducing the crosstalk between a first differential pair of conductive paths and a second differential pair of conductive paths through a mated plug jack connection are provided. Pursuant to these methods, a first capacitor is provided in the plug that is coupled between a first of the conductive paths of the first differential pair of conductive paths and a first of the conductive paths of the second differential pair of conductive paths. A second capacitor is provided in the jack that is coupled between the first of the conductive paths of the first differential pair of conductive paths and the first of the conductive paths of the second differential pair of conductive paths. The first capacitor and the second capacitor are configured to inject crosstalk from the first differential pair of conductive paths to the second differential pair of conductive paths at substantially the same point in time when a signal is transmitted over the first differential pair of conductive paths in the direction from the plug to the jack.

In some embodiments, the first capacitor and the second capacitor also inject crosstalk from the first differential pair of conductive paths to the second differential pair of conductive paths at substantially the same point in time when a signal is transmitted over the first differential pair of conductive paths in the direction from the jack to the plug. In some embodiments, the first capacitor and the second capacitor inject approximately the same amount of crosstalk from the first differential pair of conductive paths to the second differential pair of conductive paths when a signal is transmitted over the first differential pair of conductive paths. The first capacitor may inject crosstalk having a first polarity and the second capacitor may inject crosstalk having a second polarity that is opposite the first polarity, in some embodiments, additional capacitors may be provided between additional of the conductive paths.

Pursuant to yet additional embodiments of the present invention, plug-jack communications connections are provided that include a communications jack having a plug aperture and a plurality of jack contacts, and a communications plug that is configured to be received within the plug aperture of the communications jack, the communications plug including a plurality of plug contacts, wherein at least some of the plug contacts and some of the jack contacts include a non-signal current carrying end. The communications jack includes at least a first jack capacitor that is connected between the non-signal current carrying end of a first of the jack contacts and the non-signal current carrying end of a second of the jack contacts. The communications plug includes at least a first plug capacitor that is connected between the non-signal current carrying end of a first of the plug contacts and the non-signal current carrying end of a second of the plug contacts.

In some embodiments, the plug further includes a plug printed circuit board, and the first plug capacitor is on the plug printed circuit board and is connected to the non-signal current carrying end of the first and second of the plug contacts via respective first and second non-signal current carrying conductive paths. The first plug capacitor may include a non-signal current carrying portion of the first plug contact that capacitively couples with a non-signal current carrying portion of the second plug contact. The first plug capacitor and the first jack capacitor may be configured to introduce crosstalk signals that are substantially aligned in time. Each of the plug contacts may comprise a wire having a first signal current-carrying end that is mounted in a printed circuit board and a second non-signal current carrying end.

Pursuant to still further embodiments of the present invention, plug-jack communications connections are provided that comprise a communications plug having a plurality of plug contacts, a communications jack, and a first reactive coupling circuit that has a first conductive element that is part of the communications jack and a second conductive element that is part of the communications plug. This first reactive coupling circuit injects a compensating crosstalk signal that at least partially cancels an offending crosstalk signal that is generated between two adjacent plug contacts.

Pursuant to additional embodiments of the present invention, patch cords are provided that include a communications cable comprising first through eighth insulated conductors that are contained within a cable jacket and that are configured as first through fourth differential pairs of insulated conductors. An RJ-45 communications plug is attached to a first end of the communications cable. This RJ-45 communications plug comprises a plug housing and first through eighth plug contacts that are electrically connected to respective ones of the first through eighth insulated conductors to provide four differential pairs of plug contacts. The RJ-45 communications plug also includes a printed circuit board that is mounted at least partially within the plug housing. The printed circuit board includes a first capacitor (e.g., an interdigitated finger capacitor or a plate capacitor) that injects crosstalk between a first and a second of the differential pairs of plug contacts that has the same polarity as the crosstalk injected between the first and the second differential pairs of plug contacts in the jack contact region.

Pursuant to still further embodiments of the present invention, patch cords are provided that include a communications cable comprising first through eighth insulated conductors and an RJ-45 communications plug attached to a first end of the communications cable. The RJ-45 communications plug comprises a plug housing and first through eighth plug contacts that are connected to respective ones of the first through eighth insulated conductors of the communications cable. At least some of the first through eighth plug contacts include a wire connection terminal that physically and electrically connects the plug contact to its respective insulated conductor, a jackwire contact region that is configured to engage a contact element of a mating communication jack, a signal current carrying region that is between the wire connection terminal and the jackwire contact region, a plate capacitor region which is configured to capacitively couple with an adjacent one of the plug contacts and a thin extension region that connects the plate capacitor region to the signal current carrying region.

DETAILED DESCRIPTION

Figure 1:
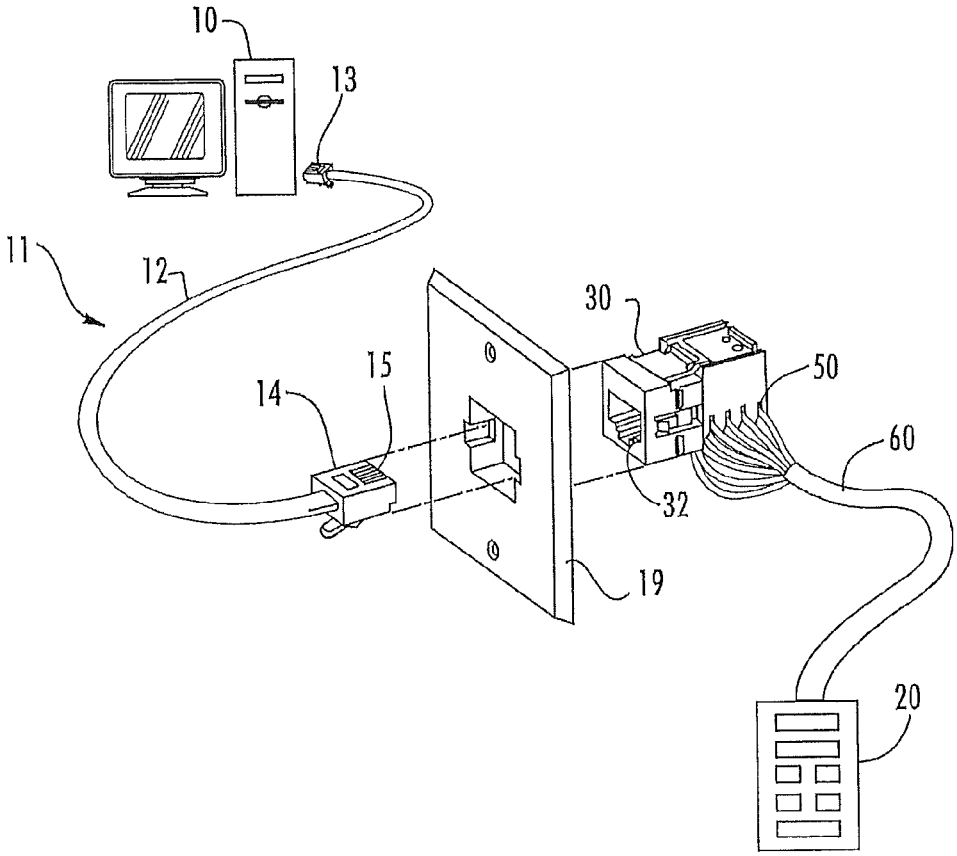
FIG. 1 (PRIOR ART)
FIG. 1 is a schematic drawing that illustrates the use of communications plug jack connectors to connect a computer to network equipment.

The present invention will be described more particularly hereinafter with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Herein, the terms "attached", "connected", "interconnected", "contacting", "mounted" and the like can mean either direct or indirect attachment or contact between elements, unless stated otherwise.

It should be noted that FIGS. 9A-9B and 10A-10B are schematic graphs that are intended to illustrate how the connectors and methods according to embodiments of the present invention may provide improved performance. Thus, it will be appreciated that FIGS. 9A-9B and 10A-10B are not necessarily intended to show exact vector magnitudes and/or exact time delays between vectors. Instead, FIGS. 9A-9B and 10A-10B are schematic in nature and illustrate, for example, how techniques according to embodiments of the present invention may be used to substantially align certain crosstalk vectors to provide enhanced crosstalk cancellation.

Herein, the term "conductive trace" refers to a conductive segment that extends from a first point to a second point on a wiring board such as a printed circuit board. Typically, a conductive trace comprises an elongated strip of copper or other metal that extends on the wiring board from the first point to the second point.

Herein, the term "signal current carrying path" is used to refer to a current carrying path on which an information signal will travel on its way from the input to the output of a communications connector (e.g., a plug, a jack, a mated-plug jack connection, etc.). Signal current carrying paths may be formed by cascading one or more conductive traces on a wiring board, metal-filled apertures that physically and electrically connect conductive traces on different layers of a wiring board, portions of contact wires or plug blades, conductive pads, and/or various other electrically conductive components over which an information signal may be transmitted. Branches that extend from a signal current carrying path and then dead end such as, for example, a branch from the signal current carrying path that forms one of the electrodes of an inter-digitated finger capacitor, are not considered part of the signal current carrying path, even though these branches are electrically connected to the signal current carrying path. While a small amount of current (e.g., 1% of the current incident at the input of the connector at 100 MHz, perhaps 5% of the current incident at the input of the connector at 500 MHz) will flow into such dead end branches, the current that flows into these dead end branches generally does not flow to the output of the connector that corresponds to the input of the connector that receives the input information signal. Herein, the current that flows into such dead end branches is referred to as a "coupling current," whereas the current that flows along a signal current carrying path is referred to herein as a "signal current."

Figure 7:
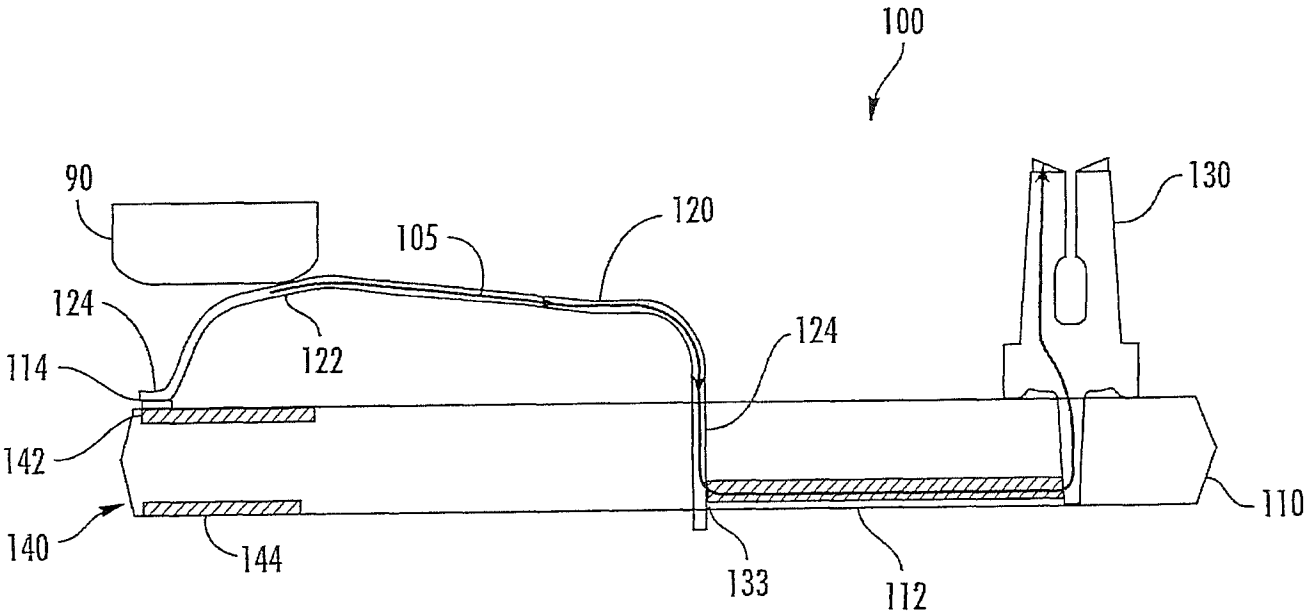
FIG. 7 PRIOR ART
FIG. 7 is an edge view of a jackwire contact that is mounted on a printed circuit board that illustrates how some connector contacts may be designed to have both a signal current carrying region and a non-signal current carrying region.

Jackwire contacts and plug blades according to embodiments of the present invention may include a first portion that is part of the signal current carrying path and a second portion that is not part of the signal current carrying path (i.e., a "non-signal current carrying portion). For example, FIG. 7 is an edge view of a jackwire contact 120 that is mounted on a printed circuit board 110 of a jack 100 (only the communications insert of jack 100 and only a single jackwire contact 120 and IDC 130 are shown to simplify the drawing). As shown in FIG. 7, a blade 90 of a plug (only the associated plug blade is depicted in FIG. 7) that is mated with jack 100 contacts a middle portion of the jackwire contact 120 that comprises the plug-jack mating point 122. An information signal that is transmitted through the plug blade 90 to the jack 100 is transmitted through the jack 100 along a signal current carrying path 105 that is denoted by the arrow in FIG. 7. As shown in FIG. 7, this signal current carrying path 105 extends from the plug-jack mating point 122 on jackwire contact 120, through the mounted end 124 of jackwire contact 120, along a conductive trace 112 on or in the printed circuit board 110 to an IDC 130 where the signal exits the jack 100. The jack 100 also includes a plate capacitor 140 that is provided at the front of printed circuit board 110. The jackwire contact 120 is electrically connected to a first electrode 142 of this capacitor 140 via a contact pad 114 that mates with the distal end 124 of jackwire contact 120. The second electrode 144 of capacitor 140 is electrically connected to the distal end of a second jackwire contact (not shown in FIG. 7) via a second contact pad and a metal plated aperture through the printed circuit board 110 (not shown in FIG. 7). While the distal end 124 of jackwire contact 120 and the first electrode 142 are electrically connected to the signal current carrying path 105, they form a dead end branch off of the signal current carrying path. Consequently, only coupling currents will fill the distal end 124 of jackwire contact 120 and the plate capacitor 140, and the signal current on jackwire contact 120 will not flow through the distal end 124 of jackwire contact 120 and the plate capacitor 140. Herein, portions of a jack or plug contact—such as distal end 124 of jackwire contact 120 of FIG. 7—that are dead end branches that generally only carry coupling currents and do not carry signal currents are referred to as "non-signal current carrying" portions of the contact.

Various industry standards specify that test plugs must be used to test jacks for compliance with the standard. For example, Tables E.2 and E.4 of the TIA/EIA-568-B.2-1 or "Category 6" standard sets forth the pair-to-pair NEXT and FEXT levels, respectively, of "high," "low" and "central" test plugs that must be used in testing communications jacks for Category 6 compliance. These test plug requirements thus effectively require that Category 6 compliant jacks be configured to compensate for the NEXT and FEXT levels of the "high," "low" and "central" test plugs. Other industry standards (e.g., the Category 6A standard) have similar requirements. Thus, while techniques are available that could be used to design RJ-45 communications plugs that have lower pair-to-pair NEXT and FEXT levels, the installed base of existing RJ-45 communications plugs and jacks have offending crosstalk levels and crosstalk compensation circuits, respectively, that were designed based on the industry standard specified levels of plug crosstalk. Consequently, lowering the crosstalk in the plug has generally not been an available option for further reducing crosstalk levels to allow for communication at even higher frequencies, as such lower crosstalk jacks and plugs would typically (without special design features) exhibit reduced performance when used with the industry-standard compliant installed base of plugs and jacks.

Embodiments of the present invention are directed to communications connectors, with the primary examples of such connectors being a communications jack and a communications plug and the combination thereof (although it will be appreciated that the invention may also be used in other types of communications connectors such as, for example, connecting blocks). The communications connectors according to embodiments of the present invention may exhibit reduced crosstalk levels and/or may operate at high frequencies. This invention also encompasses various methods of reducing crosstalk in communications connectors.

Pursuant to embodiments of the present invention, plug jack communications connectors are provided in which at least some of the offending crosstalk (e.g., NEXT) that is generated in the plug is substantially aligned in time with compensating crosstalk that is generated in the jack. By substantially aligning these crosstalk vectors in time, more complete crosstalk compensation may be realized. In some embodiments, the offending and compensating crosstalk may be substantially aligned by using a first set of capacitors that are connected to non-signal current carrying portions of the plug contacts and a second set of capacitors that are connected to the non-signal current carrying ends of the jackwire contacts of the jack.

Figure 4:
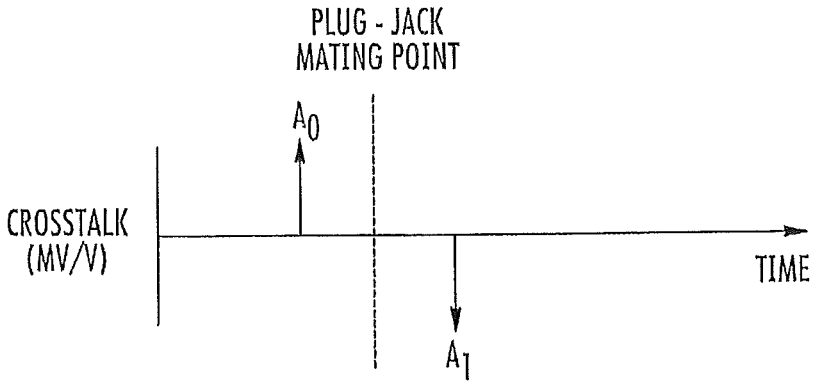
FIG. 4 (PRIOR ART)
FIG. 4 is a schematic graph of crosstalk versus time that illustrates the location of the offending and compensating crosstalk (depicted as lumped approximations) in the plug-jack connector of FIG. 3.
Figure 5A:
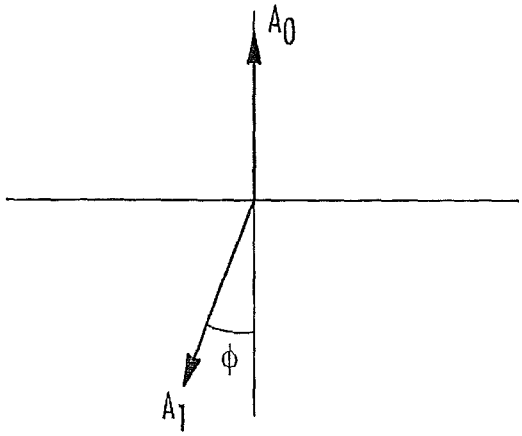
FIG. 5A (PRIOR ART)
FIG. 5A is a vector diagram that illustrates certain of the crosstalk vectors in the plug-jack connector of FIG. 3 and how the delay between the vectors results in a phase change.
Figure 5B:
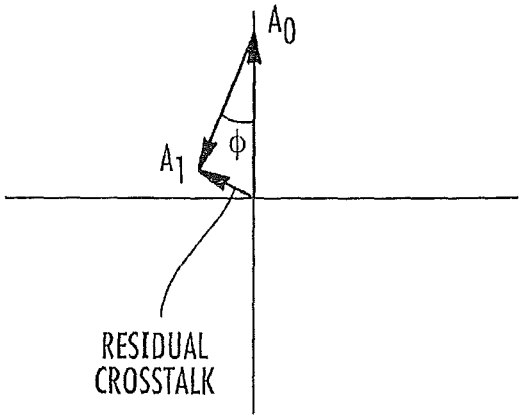
FIG. 5B (PRIOR ART)
FIG. 5B is a vector summation diagram that illustrates how the vectors of FIG. 5A will not sum to zero for higher frequency signals due to the delay between vectors $A_0$ and $A_1$.

In particular, it has been discovered that when capacitive crosstalk circuits (e.g., an inter-digitated finger capacitor) are connected to, or implemented in, the non-signal current carrying ends of the plug or jack contacts, the crosstalk injected by these capacitors appears in time after the plug-jack mating point (i.e., the point where the plug contacts mechanically and electrically engage the jack contacts) for both signals that are transmitted in the forward direction (i.e., from the plug to the jack) and signals that are transmitted in the reverse direction (i.e., from the jack to the plug). As such, where the crosstalk vector for such capacitive crosstalk circuits appears on a crosstalk timeline such as the timeline of FIG. 4 above is dependent on the direction (i.e., forward or reverse) of the signal.

The above concept will now be illustrated with respect to a communications plug 210 and a communications jack 220 that are mated together to form a mated plug-jack connector 200. The analysis below focuses solely on the crosstalk induced on one of the differential pairs from a second of the differential pairs (namely crosstalk induced on pair 1 when a signal is transmitted on pair 3 as the wire pairs are specified in the TIA/EIA-568-B.2-1 standard under the "B" wiring option) in the mated plug-jack connector 200. However, it will be appreciated that crosstalk is likewise induced on pair 3 when a signal is transmitted on pair 1, and that crosstalk typically is induced in a similar fashion between each of the pair combinations in a plug-jack connection.

Figure 8:
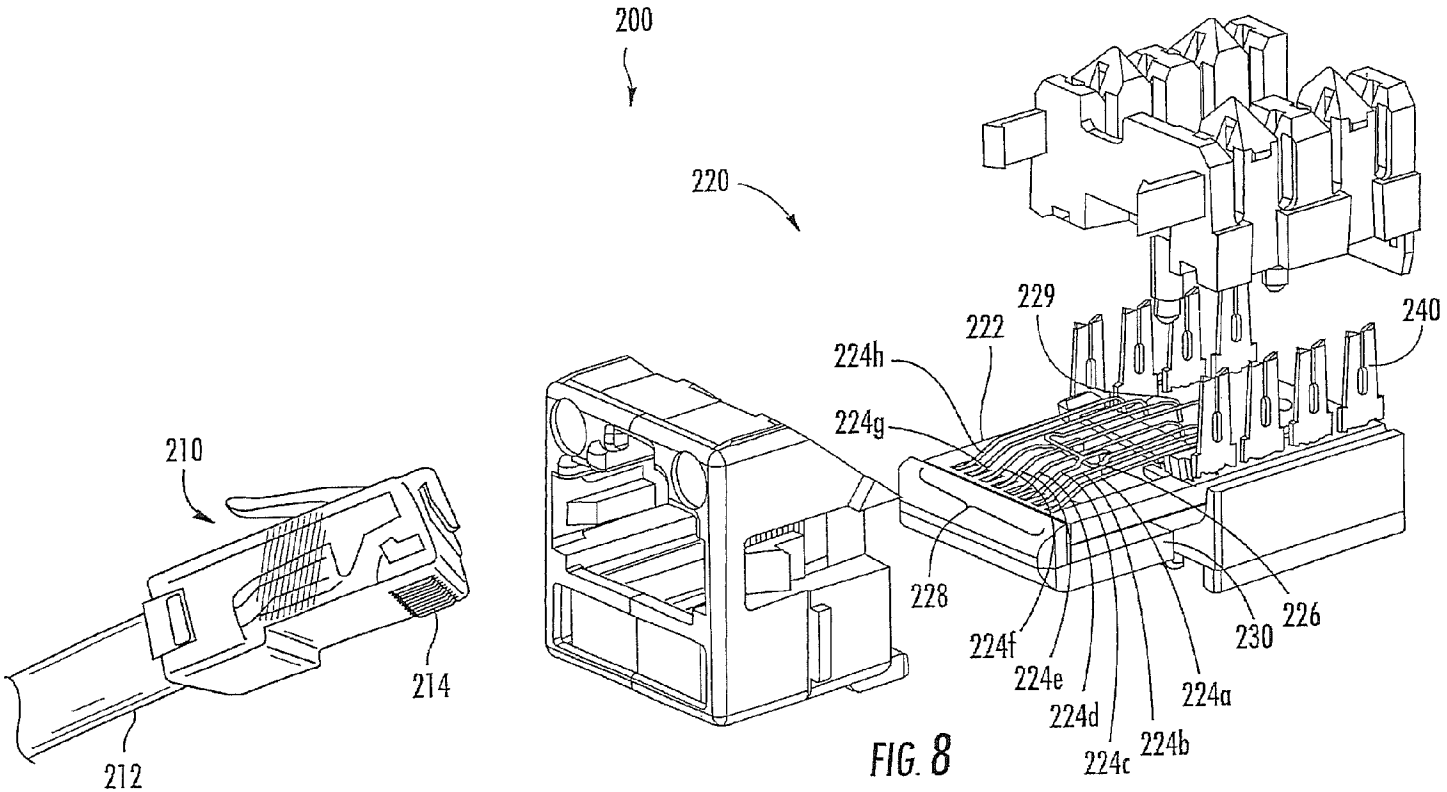
FIG. 8 PRIOR ART
FIG. 8 is a partially exploded perspective view of a conventional communications jack and a conventional communications plug which can be mated to form a plug-jack connector.

FIG. 8 is an exploded perspective view of the plug 210 and the jack 220 that form the mated plug-jack connector 200. As shown in FIG. 8, the plug 210 is attached to a cable 212 and has eight plug blades 214. The jack 220 includes a plurality of jackwire contacts 224 (which are individually labeled as jackwire contacts 224*a*-224*h* in FIG. 8) that each have a fixed end 229 that is mounted in a central portion of a printed circuit board 230 and a free distal end 228 that is received under a mandrel adjacent the forward edge of the printed circuit board 230. Each jackwire contact 224 has a plug-jack mating point 222 where the contact 224 mates with a respective one of the plug blades 214, The jackwire contacts 224*c* and 224*f* in TIA 568B positions 3 and 6 include a crossover 226 where these jackwire contacts trade positions. A plurality of IDC output terminals 240 are also included on the jack 220.

Figure 8A:
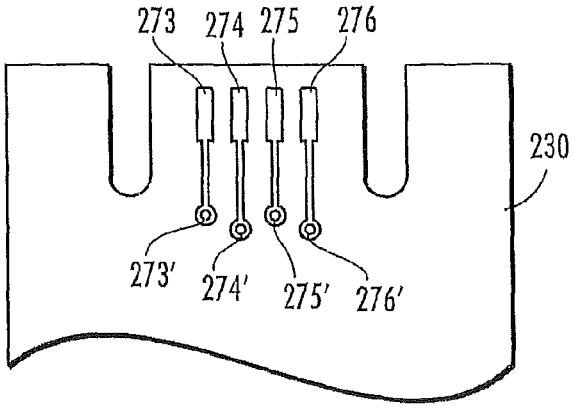
FIG. 8A PRIOR ART
FIGS. 8A-8C are plan views of a forward portion of three layers of the printed circuit board of the communications jack of FIG. 8.
Figure 8B:
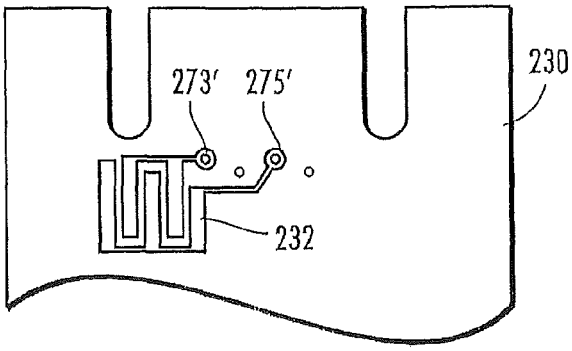
FIG. 8B PRIOR ART
Figure 8C:
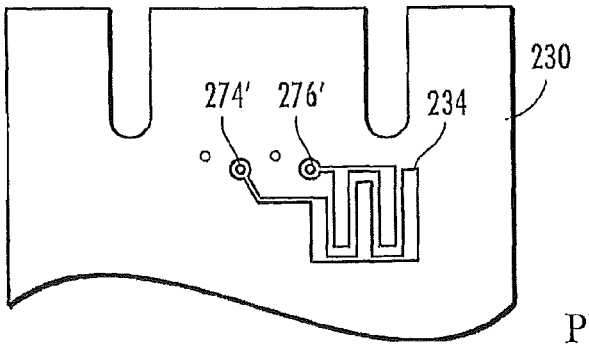
PRIOR ART FIG. 8C

FIGS. 8A-8C are partial top views showing the forward portion of each of the first three layers (where FIG. 8A shows the top layer, FIG. 8B shows next to the top layer, etc.) of the printed circuit board 230. As shown in FIG. 8A, four conductive contact pads 273-276 are provided near the forward edge of the top surface of the printed circuit board 230. As the plug 210 is inserted into the jack 220 so as to come into contact with the jackwire contacts 224, the blades and/or the housing of the plug 210 force the distal ends 228 of the jackwire contacts 224 to deflect downwardly toward the top surface of the printed circuit board 230, As a result of this deflection, the distal end 228 of each of jackwire contacts 224*c*-224*f* comes into physical and electrical contact with a respective one of the contact pads 273-276, each of which is located directly under the distal end 228 of a respective one of jackwire contacts 224*c*-224*f*.

As shown in FIG. 8A, a respective conductive trace connects each of the contact pads 273-276 to a respective metal-filled via 273'-276'. As shown in FIG. 8B, the metal-plated via 273' electrically connects contact pad 273 to the first electrode of an inter-digitated finger capacitor 232, while the metal-plated via 275' electrically connects contact pad 275 to the second electrode of inter-digitated finger capacitor 232. In this manner, the contact pads 273, 275 are used to connect inter-digitated finger capacitor 232 to the jackwire contacts 224*c* and 224*e*, thereby providing first stage capacitive crosstalk compensation between pairs 1 and 3 that is connected at the non-signal current carrying ends of jackwire contacts 224*c* and 224*e*. Similarly, as shown in FIG. 8C, the metal-plated via 274' electrically connects contact pad 274 to the first electrode of an inter-digitated finger capacitor 234, while the metal-plated via 276' electrically connects contact pad 276 to the second electrode of inter-digitated finger capacitor 234. In this manner, the contact pads 274, 276 are used to connect inter-digitated finger capacitor 234 to the jackwire contacts 224*d* and 224*f*, providing additional first stage capacitive crosstalk compensation between pairs 1 and 3 that is connected at the non-signal current carrying ends of jackwire contacts 224*d* and 224*f*.

The jack 220 also includes inter-digitated finger capacitors 236, 238 (not visible in the figures) on printed circuit board 230 that are connected to the metal plated holes on the printed circuit board 230 that hold the IDCs that are electrically connected to jackwire contacts 224*c*-224*f*. In particular, capacitor 236 (not visible in FIG. 8) is coupled between the metal plated holes for the IDCs that are connected to jackwire contacts 224*c* and 224*d*, and capacitor 238 (not visible in the figures) is coupled between the metal plated holes for the IDCs that are connected to jackwire contacts 224*e* and 224*f*.

Figure 9A:
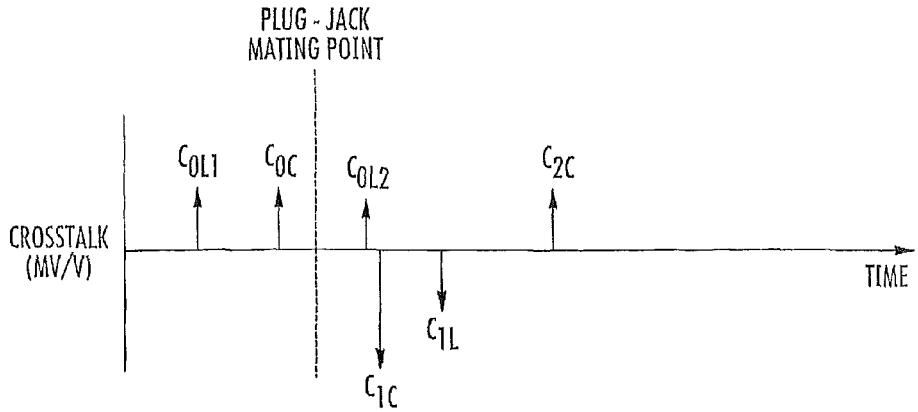
FIG. 9A PRIOR ART
FIGS. 9A and 9B are schematic graphs that illustrate the location of the offending and compensating crosstalk in a conventional plug-jack connector for a signal traveling in the forward and reverse directions, respectively, through the connector.

FIG. 9A is a crosstalk timeline for signals that travel in the forward direction through the plug-jack connector 200. In creating FIG. 9A, it has been assumed that the offending crosstalk in the plug 210 (i.e., the crosstalk from the conductors of pair 3 onto the conductors of pair 1 in the plug 210) comprises inductive coupling $C_{0L1}$ and capacitive coupling $C_{0C}$. Both types of coupling occur from conductor 3 to conductor 4 and from conductor 6 to conductor 5. In a conventional plug, the inductive coupling $C_{0L1}$ typically arises in both the insulated wires coming into the plug 210 from the cable 212 and in the plug blades 214 (where the blades for conductors 3 and 4 are directly adjacent to each other and the blades for conductors 5 and 6 are directly adjacent to each other). The capacitive coupling $C_{0C}$ mostly arises in the plug blades 214 where the adjacent plug blades act like plate capacitors.

The crosstalk from pair 3 to pair 1 that is present in the jack 220 is typically more complex. For purposes of this example, it has been assumed that offending inductive crosstalk $C_{0L2}$ is present in the jackwire contacts 224 between the plug-jack mating point 222 and the crossover location 226 where the jackwire contacts for conductors 3 and 6 cross over each other. While there is also some amount of offending capacitive coupling in this portion of the jackwire contacts 224, the level of such capacitive crosstalk is relatively small and has been ignored here to simplify the analysis.

As discussed above, a first capacitor 232 is coupled between the distal ends 228 of jackwires 224*c* and 224*e*, and a second capacitor 234 is coupled between the distal ends 228 of jackwires 224*d* and 224*f*. The capacitors 232, 234 generate a capacitive compensating crosstalk $C_{1C}$. The polarity of the crosstalk $C_{1C}$ is opposite the polarity of the crosstalk vectors $C_{0L1}$, $C_{0L2}$ and $C_{0C}$. The distal ends 228 of the jackwire contacts 224 are non-signal current carrying, as the signal current carrying path through the jack 220 runs from the plug-jack mating points 222 on the jackwire contacts 224, through the mounted base portions 229 of the contacts 224 onto the printed circuit board 230. Conductive paths on the printed circuit board 230 provide the remainder of the signal current carrying path between each jackwire contact 224 and a respective one of the IDC output terminals 240. Thus, the capacitors 232, 234 that generate the capacitive compensating crosstalk $C_{1C}$ are connected to the non-signal current carrying end of the jackwire contacts 224.

After the crossover 226, jackwire 224*c* runs next to jackwire 224*e* and jackwire 224*d* runs next to jackwire 224*f*. The inductive coupling between these portions of the jackwire contacts 224 generates a compensating inductive crosstalk $C_{1L}$. The polarity of the crosstalk $C_{1L}$ is also opposite the polarity of the crosstalk $C_{0L1}$, $C_{0L2}$ and $C_{0C}$ due to the crossover 226. Together, the vectors $C_{1C}$ and $C_{1L}$ comprise a first stage of compensating crosstalk. Finally, the capacitors 236, 238 (not visible in FIG. 8) provide a capacitive compensating crosstalk $C_{2C}$ that comprises a second stage of capacitive compensating crosstalk. The polarity of crosstalk $C_{2C}$ is the same as the polarity of crosstalk $C_{0C}$, $C_{0L1}$ and $C_{0L2}$.

In FIG. 9A, each of the crosstalk stages discussed above is represented by a vector which indicates the magnitude of the crosstalk (shown by the height of the vector), the polarity of the crosstalk (shown by the up or down direction of the vector) and the relative locations in time where the coupling occurs when the signal is transmitted in the forward direction from the plug 210 to the jack 220. It will be appreciated that each of the inductive crosstalk circuits will generate inductive coupling over some distance and hence the inductive coupling will be distributed over time. However, in order to simplify this example, each of the inductive crosstalk stages are represented in FIG. 9A by a single vector (e.g., vector $C_{0L1}$), where the magnitude of the vector is equal to the sum of the distributed coupling and the vector is located on the time axis at the location in time that corresponds to the magnitude-weighted center-point of the distributed inductive coupling. It will also be appreciated that at least some of the capacitive crosstalk circuits may also be distributed in time as well (e.g., the capacitive coupling in the plug blades that generates crosstalk vector $C_{0C}$), but in order to simplify the discussion each capacitive coupling is also represented by a single vector, where the magnitude of the vector is equal to the sum of the distributed capacitive coupling and the vector is located at a location along the time axis that corresponds to the magnitude-weighted center-point of the distributed capacitive coupling. The dotted vertical line in FIG. 9A indicates the plug-jack mating point (i.e., the location on the time axis where the leading edge of a signal transmitted through plug 210 reaches the jackwire contacts 224).

As shown in FIG. 9A, when a signal is transmitted in the forward direction through the plug-jack connector 200, the first crosstalk that is generated is vector $C_{0L1}$, followed shortly thereafter by vector $C_{0C}$. The vector $C_{0L1}$ is to the left of vector $C_{0C}$ because significant inductive coupling typically starts to occur farther back in the plug 210 (i.e., farther away from the plug-jack mating point 222) than does significant capacitive coupling. Continuing from left to right in FIG. 9A, we next come to vector $C_{0L2}$, which is the last of the offending crosstalk, and which occurs after the plug-jack mating point 222. Vector $C_{1C}$ follows shortly after vector $C_{0L2}$ and, in some embodiments, may come before vector $C_{0L2}$, as the capacitors that generate vector $C_{1C}$ are connected to the non-signal current carrying portions of the jackwire contacts 224, and hence may be at a very small delay from the plug-jack mating point 222. Vector $C_{1L}$ follows vector $C_{1C}$. Finally, vector $C_{2C}$ follows some distance after vector $C_{1L}$.

Figure 9B:
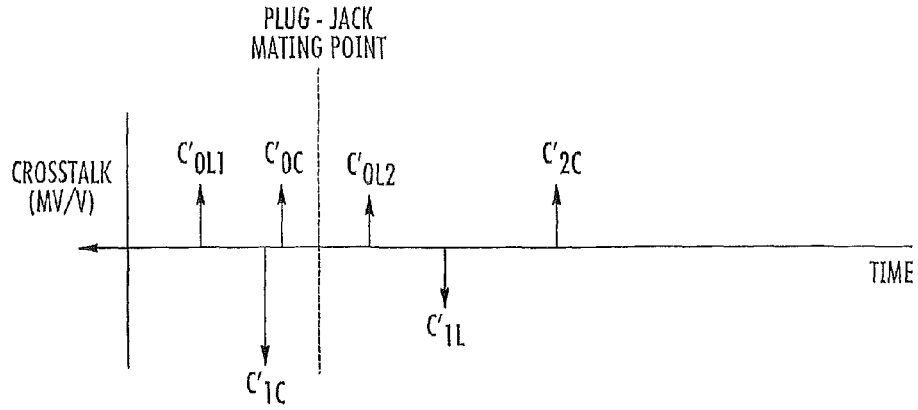
FIG. 9B PRIOR ART

It has been discovered that capacitive crosstalk that is generated in, or connected to, the non-signal current carrying part of the plug or jack contacts appears at a different location in time depending upon the direction that the signal travels through the plug-jack connector 200. This can be seen by comparing FIG. 9A with FIG. 9B, which is a crosstalk timeline for signals that travel in the reverse direction through the plug-jack connector 200 (a prime has been added to each of the crosstalk vectors in FIG. 9B to facilitate comparisons between FIGS. 9A and 9B). In FIG. 9B, the time axis proceeds from right to left (whereas the time axis proceeds from left to right in FIG. 9A), in order to reflect the reversal of direction of signal travel.

Aside from the change in direction of the time axis, FIG. 9B is almost identical to FIG. 9A. However, in FIG. 9B, the location of the crosstalk vector $C'_{1C}$ has changed to be on the left side of the plug-jack mating point 222. As can be seen by comparing FIGS. 9A and 9B, the crosstalk vectors $C_{1C}$ and $C'_{1C}$ are mirror images of each other about the plug-jack mating point 222. Thus, the crosstalk vectors $C_{1C}$ and $C'_{1C}$ appear after the plug-jack mating point 222, regardless of the direction of signal travel through the plug-jack connector 200.

The reason that the crosstalk vectors $C_{1C}$ and $C'_{1C}$ in the example of FIGS. 9A and 9B appear after the plug-jack mating point 222 irrespective of the direction of signal travel can be understood as follows. When a signal travels in the forward direction (FIG. 9A) from the plug 210 to the jack 220, the signal travels over one of the plug blades 214 to a respective one of the jackwire contacts 224, and only then travels to one of the capacitors 232, 234 on the printed circuit board 230 (see FIG. 8). As such, the crosstalk vector $C_{1C}$ will appear in time after the time that the signal reaches the plug-jack mating point 222. When, on the other hand, a signal travels in the reverse direction (FIG. 9B) from the jack 220 to the plug 210, the signal travels through an IDC 240 along a trace on the printed circuit board 230 to the mounted end of one of the jackwire contacts 224, and then along the jackwire contact 224 to the central portion of the contact that mates with a respective one of the plug blades 214 (i.e., the plug-jack mating point 222) where the signal is transferred to one of the plug blades 214. Since the capacitors 232, 234 are located off of the free ends of the jackwire contacts 224, the signal will only reach one of these capacitors 232, 234 after it has reached the plug-jack mating point 222, and hence the crosstalk vector $C'_{1C}$ will also appear in time after the time that the signal reaches the plug-jack mating point 222.

As is discussed in the aforementioned '358 patent, one common technique that is used to minimize crosstalk is the use of multi-stage crosstalk compensation. When multi-stage crosstalk compensation is used, both the magnitude of the compensating crosstalk vectors and the delay therebetween may be controlled to maximize crosstalk cancellation in a desired frequency range. Since the locations of crosstalk compensating vectors $C_{1C}$ and $C'_{1C}$ change depending upon the direction of signal travel as shown in FIGS. 9A and 9B, the compensation provided by the multi-stage crosstalk compensation circuits in jack 220 will differ depending upon whether or not the signal is traveling through the plug-jack connector 200 in the forward or reverse direction. As a result, it may be more difficult to achieve a high degree of crosstalk cancellation in both the forward and reverse directions.

When a signal is transmitted in the forward direction through the plug-jack connector 200, the signal splits at the plug-jack mating point 222, such that a first portion of the signal passes along its respective the jackwire contact 224 to the base of the jackwire contact 224, while the remaining second portion of the signal being passes (with an associated delay) to the distal end of the respective jackwire contact 224. It will also be appreciated that the non-signal current carrying path to the distal end of the jackwire contact 224 that receives the second portion of the signal comprises an unmatched transmission line tap that will generally respond to the second portion of the signal with multiple reflections which must be accounted for by the crosstalk compensation scheme. While the discussion below does not outline the effect of these reflections in order to simplify the discussion, it can be seen by further analysis of the same type that embodiments of the present invention may provide matching compensation for these reflections as well.

Pursuant to further embodiments of the present invention, communications plugs are provided which include intentionally introduced offending capacitive crosstalk that is inserted using capacitors that are attached or coupled to the non-signal current carrying ends of the plug contacts or that are otherwise designed to inject an offending crosstalk signal after the plug jack mating point. As noted above, pursuant to various industry standards such as, for example, the TIA/EIA 568-B.2.1 Category 6 standard, communications plugs are intentionally designed to introduce specified levels of both NEXT and FEXT between each combination of two differential pairs in order to ensure that the plugs will meet minimum performance levels when used in previously installed jacks that were designed to compensate for offending crosstalk at these levels. Conventionally, the specified crosstalk levels were generated in the plug via inductive coupling in the wires of the cable and in the plug blades and by capacitive coupling between adjacent plug blades, which acted as plate capacitors. Consequently, the crosstalk that was introduced in conventional plugs would appear on the plug side of the plug-jack mating point 222, as can be seen by vectors $C_{0L1}$ and $C_{0C}$ in FIG. 9A and by vectors $C'_{0L1}$ and $C'_{0C}$ in FIG. 9B.

As discussed above, by generating at least some of the industry standard-specified offending crosstalk using capacitors that are, for example, coupled to the non-signal current carrying ends of the plug contacts, the offending crosstalk generated in these capacitors will appear in time after the plug-jack mating point 222, regardless of the direction of signal travel (i.e., the offending crosstalk will appear on the jack side of the plug-jack mating point 222 when a signal is transmitted from the plug 210 to the jack 220, and will appear on the plug side of the plug-jack mating point 222 when a signal is transmitted from the jack 220 to the plug 210). Connectors according to certain embodiments of the present invention use such capacitors to provide for improved crosstalk cancellation.

In particular, pursuant to embodiments of the present invention, plug jack connectors may be provided that have plugs and jacks that each include capacitors that insert crosstalk at the non-signal current carrying ends of the plug and jack contacts, respectively. The capacitors on both the plug and the jack thus inject crosstalk after the plug-jack mating point 222, regardless of the direction of signal travel. As a result, if the capacitors in the plug and jack are designed to be at the same delay from the plug-jack mating point 222, the crosstalk vectors for the capacitors may appear at substantially the same point on the time axis.

Figure 6A:
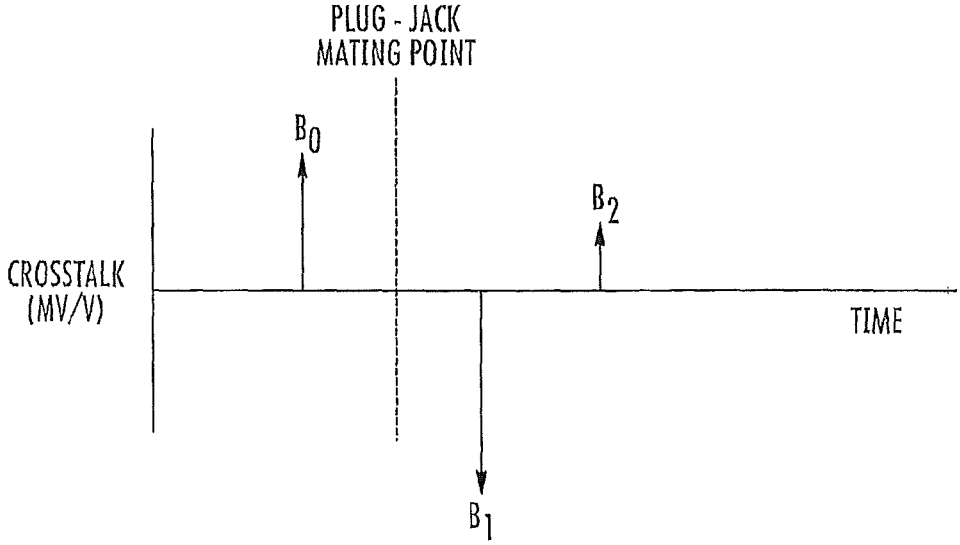
FIG. 6A (PRIOR ART)
FIG. 6A is a schematic graph of crosstalk versus time that illustrates the location of the offending and compensating crosstalk (depicted as lumped approximations) in a plug jack connector that implements multi-stage crosstalk compensation.
Figure 6B:
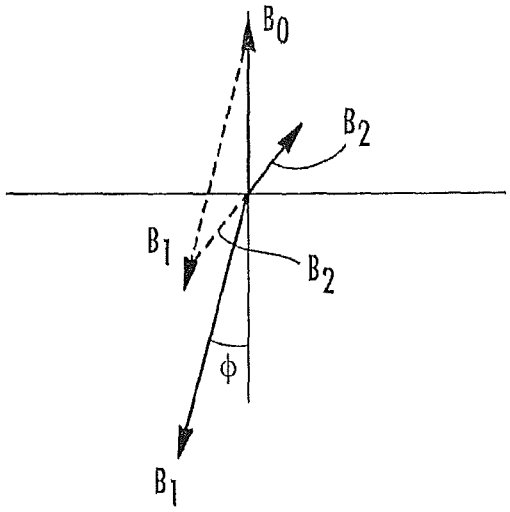
FIG. 6B (PRIOR ART)
FIG. 6B is a vector summation diagram that illustrates how the multi-stage compensation crosstalk vectors $B_1$ and $B_2$ of FIG. 6A can cancel the offending crosstalk at a selected frequency.

By designing the capacitors that are connected to the non-signal current carrying ends of the plug contacts to generate offending crosstalk (i.e., crosstalk having a first polarity) and by designing the capacitors that are connected to the non-current carrying ends of the jackwire contacts to generate first stage compensating crosstalk (i.e., crosstalk having a second polarity that is opposite the first polarity), it is possible to generate oppositely polarized offending and compensating crosstalk vectors at substantially the same point in time. If the compensating crosstalk vector has the same magnitude as the offending crosstalk vector, it may be possible to completely cancel the offending crosstalk vector at all frequencies. This is in contrast to the multi-stage compensation crosstalk cancellation schemes that are discussed in the aforementioned '358 patent (and in FIGS. 6A and 6B above), which can be used to provide complete crosstalk cancellation at a single frequency, or to provide high—but not complete—levels of crosstalk cancellation over a range of frequencies of interest.

Figure 10A:
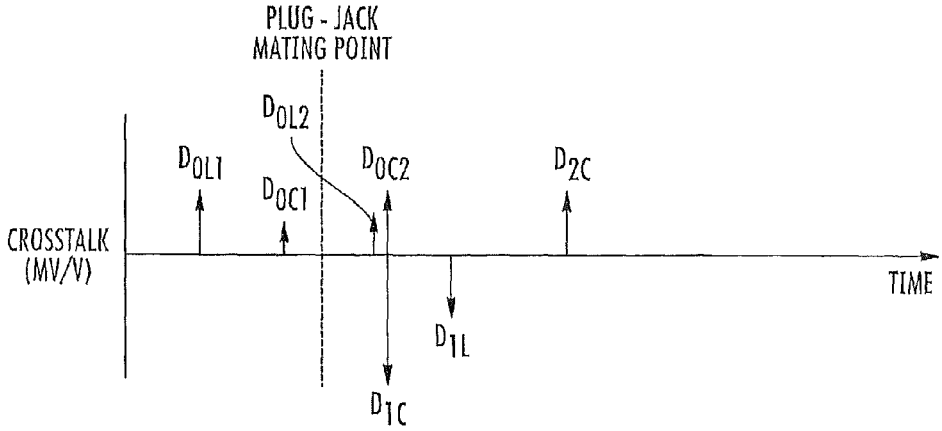
FIGS. 10A and 10B are schematic graphs that illustrate the location of the offending and compensating crosstalk in a plug-jack connector according to embodiments of the present invention for a signal traveling in the forward and reverse directions, respectively, through the connector.
Figure 10B:
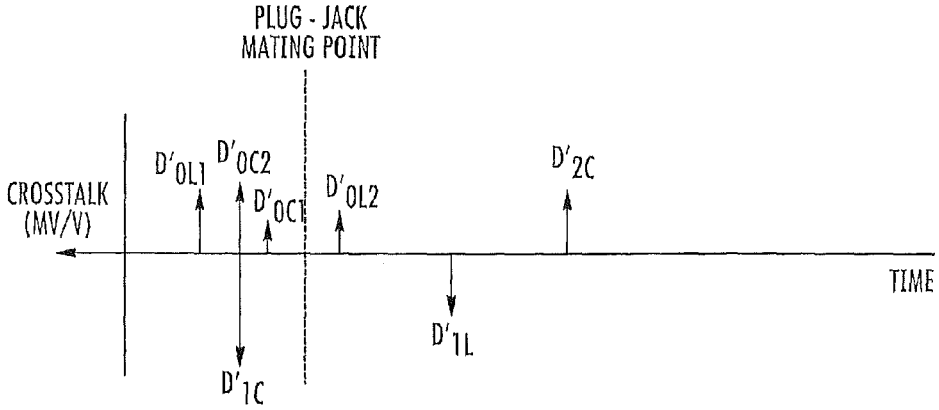

By way of example, if the plug 210 of FIG. 8 were modified to (1) have reduced capacitance in the plug contacts and (2) to include additional capacitors that generate offending crosstalk that are attached to the non-signal current carrying ends of the plug contacts, the crosstalk generated by the plug-jack connector 200 would appear as shown in FIGS. 10A and 10B. In FIGS. 10A and 10B, the crosstalk vectors are labeled using the first letter "D" so that they can readily be compared and contrasted with the crosstalk vectors in FIGS. 9A and 9B which are labeled with the first letter "C." As shown in FIG. 10A, the crosstalk vector $D_{0C1}$ (which is the crosstalk in the plug blades) is reduced considerably as compared to its corresponding vector $C_{0C}$ in FIG. 9A, Likewise, FIG. 10A includes an additional offending crosstalk vector $D_{0C2}$ that reflects the offending crosstalk generated in the capacitors that are attached to the non-signal current carrying ends of the plug contacts. Consistent with the discussion above, the new vector $D_{0C2}$ is located after the plug-jack mating point 222 (i.e., on the jack side of the plug-jack mating point 222, since the signal is being transmitted in the forward direction from the plug to the jack)

As shown in FIG. 10A, in some embodiments, the offending crosstalk vector $D_{0C2}$ may be substantially aligned in time with the first stage compensating crosstalk vector $D_{1C}$. The magnitude of the offending crosstalk vector $D_{0C2}$ may be smaller than the magnitude of the first stage compensating crosstalk vector $D_{1C}$. In such embodiments, the crosstalk vector $D_{0C2}$ may be substantially completely cancelled at all frequencies by a portion of crosstalk vector $D_{1C}$. As a result, the only additional offending crosstalk that may require compensation in such embodiments are the crosstalk vectors $D_{0L1}$, $D_{0C1}$ and $D_{0L2}$. As shown in FIG. 10A, these vectors may be relatively small, as much of the offending crosstalk in the plug may, in some embodiments, be injected by the capacitors at the non-signal current carrying ends of the plug contacts (i.e., crosstalk vector $D_{0C2}$). The remainder of vector $D_{1C}$ (i.e., the portion that is not used to cancel vector $D_{0C2}$) along with vectors $D_{1L}$ and $D_{2C}$ may be used to approximately cancel the offending crosstalk $D_{0L1}$, $D_{0C1}$ and $D_{0L2}$. As there is less overall offending crosstalk that requires cancellation, the residual crosstalk after cancellation may also be less, providing higher margins and/or allowing for communications at higher frequencies.

Moreover, as shown in FIG. 10B, the same or similar improved performance may also be realized with respect to signals that are transmitted in the reverse direction through the plug-jack connector, as the vectors $D_{0C2}$ and $D_{1C}$ both move to their mirror image locations about the plug-jack mating point 222 with respect to a signal traveling in the reverse direction, as can be seen by comparing FIGS. 10A and 10B (note that the crosstalk vectors in FIG. 10B include a prime to distinguish them from the corresponding vectors in FIG. 10A). Thus, the offending crosstalk vector $D_{0C2}/D'_{0C2}$ that is generated by the capacitors that are attached to the non-signal current carrying ends of the plug contacts and the compensating crosstalk vector $D_{1C}/D'_{1C}$ that is generated by the capacitors that are attached to the non-signal current carrying ends of the jack contacts are both located at a point in time that is after the plug-jack mating point when a signal is transmitted over the first differential pair of conductive paths in either the forward direction from the plug to the jack or in the reverse direction from the jack to the plug. Consequently, the plug-jack connector that corresponds to FIGS. 10A and 10B can not only provide improved crosstalk performance, but can also provide the improvement with respect to signals transmitted in both the forward and reverse directions.

Figure 11:
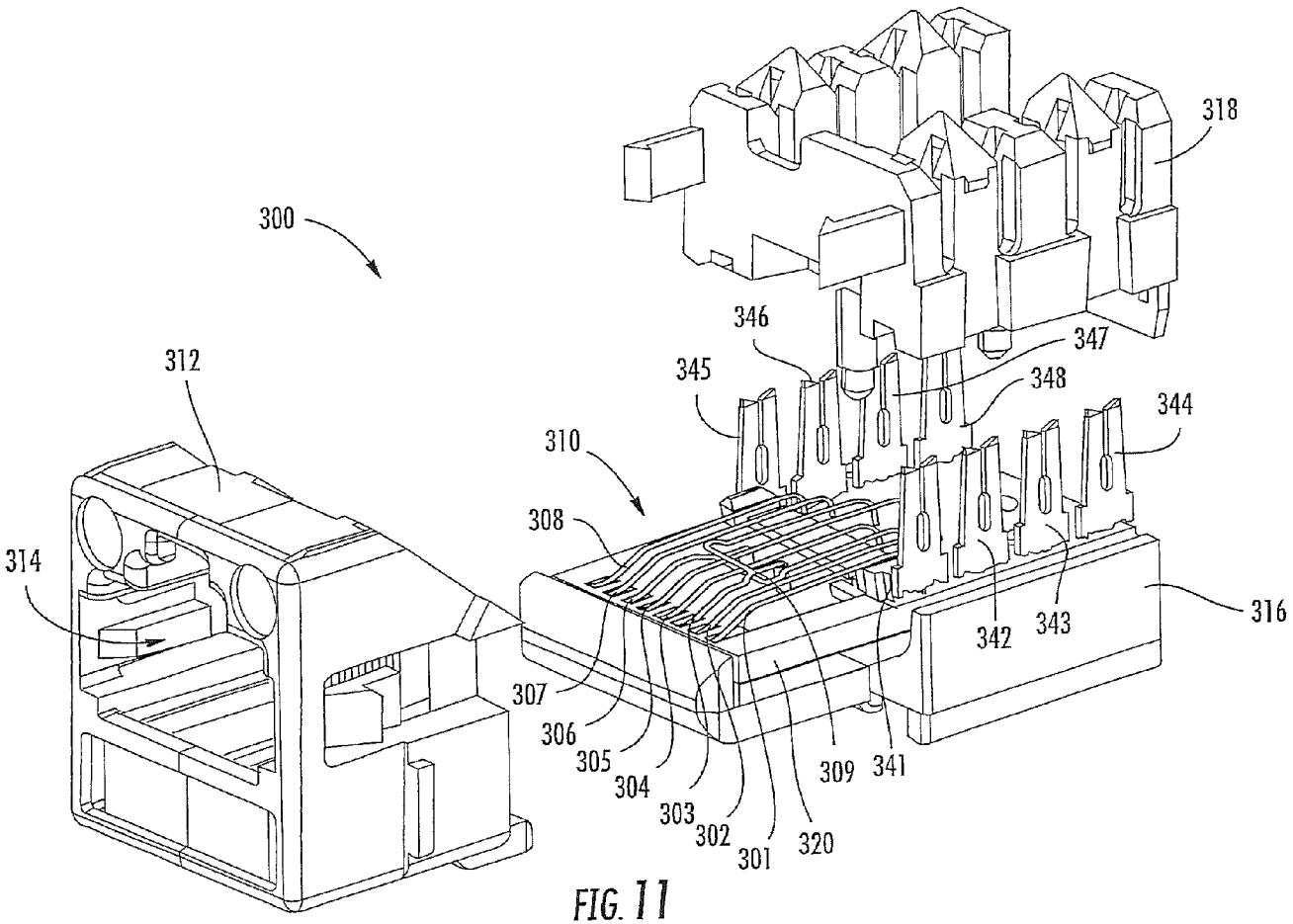
FIG. 11 is an exploded perspective view of a communications jack that may be used in embodiments of the present invention.
Figure 12A:
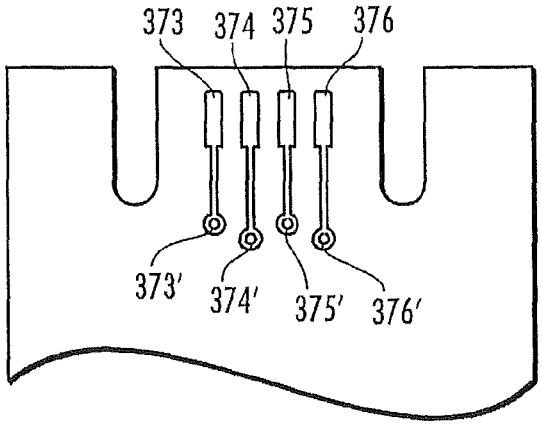
FIGS. 12A-12C are plan views of a forward portion of three layers of the printed circuit board of the communications jack of FIG. 11.
Figure 12B:
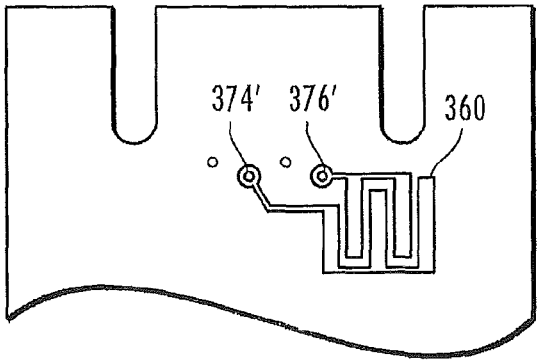
Figure 12C:
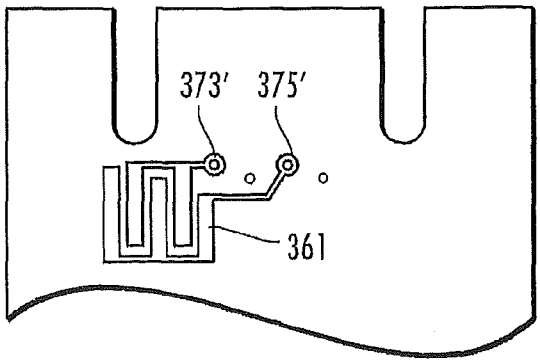

FIGS. 11 and 12 illustrate a communications jack 300 that may be used in the plug-jack connectors according to embodiments of the present invention. In particular, FIG. 11 is an exploded perspective view of the communications jack 300, and FIGS. 12A-12C are plan views of a forward portion of three layers of a printed circuit board 320 of the communications jack 300.

As shown in FIG. 11, the jack 300 includes a jack frame 312 having a plug aperture 314 for receiving a mating plug, a cover 316 and a terminal housing 318. These housing components 312, 316, 318 may be conventionally formed and not need be described in detail herein. Those skilled in this art will recognize that other configurations of jack frames, covers and terminal housings may also be employed with the present invention. It will also be appreciated that the jack 300 is often mounted in an inverted orientation from that shown in FIG. 11 to reduce buildup of dust and dirt on the jackwire contacts 301-308.

The jack 300 further includes a communications insert 310 that is received within an opening in the rear of the jack frame 312. The bottom of the communications insert 310 is protected by the cover 316, and the top of the communications insert 310 is covered and protected by the terminal housing 318. The communications insert 310 includes a wiring board 320, which in the illustrated embodiment is a substantially planar multi-layer printed wiring board.

Eight jackwire contacts 301-308 are mounted on a top surface of the wiring board 320. The jackwire contacts 301-308 may comprise conventional contacts such as the contacts described in U.S. Pat. No. 7,204,722. Each of the jackwire contacts 301-308 has a fixed end that is mounted in a central portion of the wiring board 320 and a distal end that extends into a respective one of a series of slots in a mandrel that is located near the forward end of the top surface of the wiring board 320. Each of the jackwire contacts 301-308 extends into the plug aperture 314 to form physical and electrical contact with the blades of a mating plug. The distal ends of the jackwire contacts 301-308 are "free" ends in that they are not mounted in the wiring board 320, and hence can deflect downwardly when a plug is inserted into the plug aperture 314. As is also shown in FIG. 11, jackwire contacts 303 and 306 include a crossover 309 where these jackwire contacts cross over/under each other without making electrical contact. The crossover 309 provides inductive compensatory crosstalk, as will be described in more detail below. Each of the jackwire contacts 301-308 also includes a plug contact region that is located between the crossover 309 and the distal ends of the jackwire contacts. The jack 300 is configured so that each blade of a mating plug comes into contact with the plug contact region of a respective one of the jackwire contacts 301-308 when the plug is inserted into the plug aperture 314.

Figure 2:
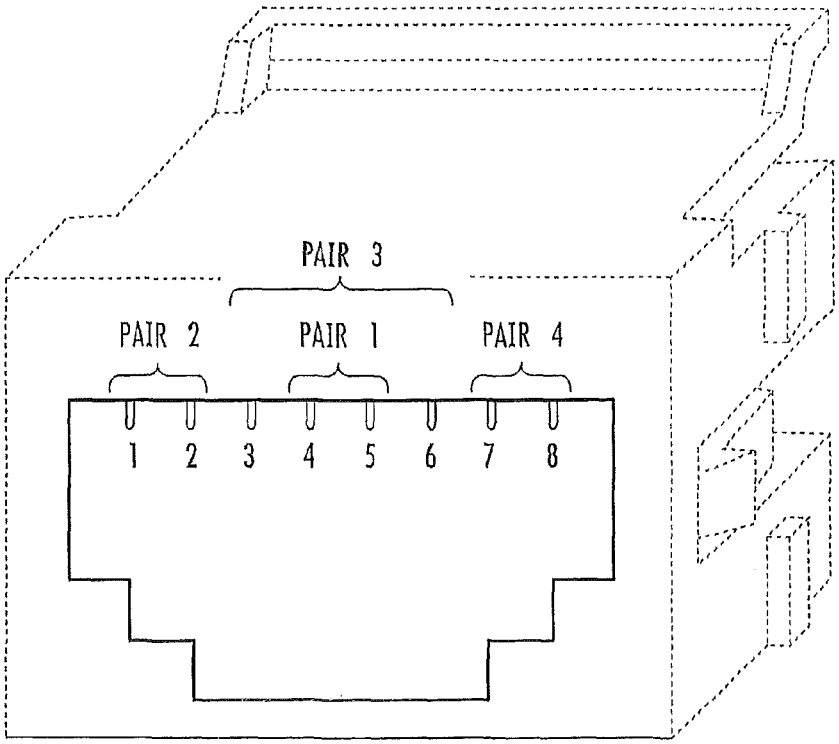
FIG. 2 (PRIOR ART)
FIG. 2 is a schematic diagram illustrating the modular jack contact wiring assignments for a conventional 8-position communications jack (TIA 568B) as viewed from the front opening of the jack.
Figure 3:
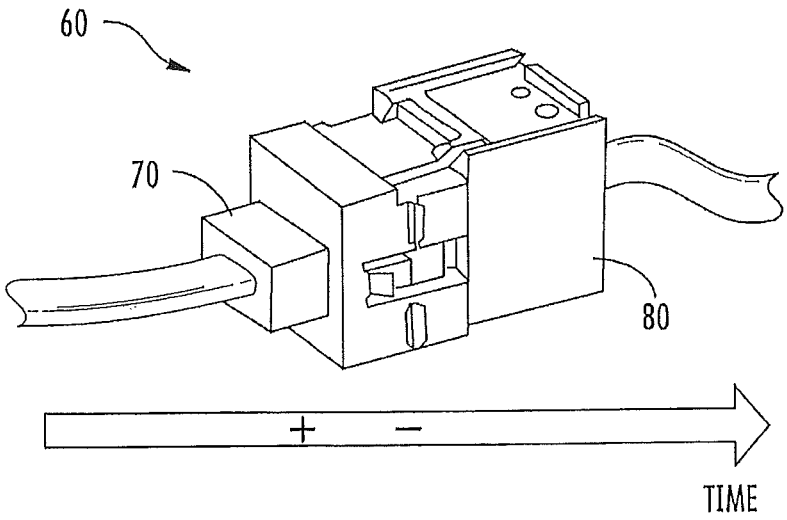
FIG. 3 (PRIOR ART)
FIG. 3 is a schematic diagram of a prior art communications plug that is mated with a prior art communications jack that introduces a compensating crosstalk signal in the jack.

The jackwire contacts 301-308 are arranged in pairs defined by TIA 568B (see FIG. 2 and discussion thereof above). Accordingly, in the plug contact region, contacts 304, 305 (pair 1) are adjacent to each other and in the center of the sequence of contacts, contacts 301, 302 (pair 2) are adjacent to each other and occupy the rightmost two contact positions (from the vantage point of FIG. 11), contacts 307, 308 (pair 4) are adjacent to each other and occupy the leftmost two positions (from the vantage point of FIG. 11), and contacts 303, 306 (pair 3) are positioned between, respectively, pairs 1 and 2 and pairs 1 and 4. These contact positions are consistent with the contact positions depicted in FIG. 2, as the jack 300 is depicted in FIG. 11 in an inverted orientation. The jackwire contacts 301-308 may be mounted to the wiring board 320 via, for example, interference fit, compression fit or soldering within metal-plated holes (not visible in FIG. 11) in the wiring board 320 or by other means known to those of skill in the art As is also shown in FIG. 11, the communications insert 310 includes eight output terminals 341-348, which in this particular embodiment are implemented as insulation displacement contacts (IDCs) that are inserted into eight respective IDC apertures (not visible in FIG. 11) in the wiring board 320. As is well known to those of skill in the art, an IDC is a type of wire connection terminal that may be used to make mechanical and electrical connection to an insulated wire conductor. The IDCs 341-348 may be of conventional construction and need not be described in detail herein. Terminal cover 318 includes a plurality of pillars that cover and protect the IDCs 341-348. Adjacent pillars are separated by wire channels. The slot of each of the IDCs 341-348 is aligned with a respective one of the wire channels. Each wire channel is configured to receive a conductor of a communications cable so that the conductor may be inserted into the slot in a respective one of the IDCs 341-348.

FIGS. 12A-12C are partial top views showing the forward portion of each of the first three layers (where FIG. 12A shows the top layer, FIG. 12B shows next to the top layer, etc.) of the wiring board 320. In particular, FIGS. 12A-12C illustrate how capacitive first stage crosstalk compensation is implemented on the wiring board 320 of jack 300. As shown in FIG. 12A, four contact pads 373-376 are provided near the forward edge of the top surface of the wiring board 320. The contact pads 373-376 may comprise any conductive element such as, for example, immersion tin plated copper pads. As a mating plug is inserted into the plug aperture 314 so as to come into contact with the jackwire contacts 301-308, the blades and/or the housing of the plug force the distal ends of the jackwire contacts 301-308 to deflect downwardly toward the top surface of the wiring board 320. As a result of this deflection, the distal end of each of jackwire contacts 303-306 comes into physical and electrical contact with a respective one of the contact pads 373-376, each of which are located directly under the distal end of its respective jackwire contact 303-306.

As shown in FIG. 12A, a respective conductive trace connects each of the contact pads 373-376 to a respective metal-filled via 373'-376'. As shown in FIG. 12B, the metal-plated hole 374' electrically connects contact pad 374 to the first electrode of an inter-digitated finger capacitor 360, while the metal-plated hole 376' electrically connects contact pad 376 to the second electrode of inter-digitated finger capacitor 360. In this manner, the contact pads 374, 376 are used to connect inter-digitated finger capacitor 360 to the jackwire contacts 304 and 306, thereby providing first stage capacitive crosstalk compensation between pairs 1 and 3 that is connected at the non-signal current carrying ends of jackwire contacts 304 and 306. Similarly, as shown in FIG. 12C, the metal-plated hole 373' electrically connects contact pad 373 to the first electrode of an inter-digitated finger capacitor 361, while the metal-plated hole 375' electrically connects contact pad 375 to the second electrode of inter-digitated finger capacitor 361. In this manner, the contact pads 373, 375 are used to connect inter-digitated finger capacitor 361 to the jackwire contacts 303 and 305, providing additional first stage capacitive crosstalk compensation between pairs 1 and 3 that is connected at the non-signal current carrying ends of jackwire contacts 303 and 305, The wiring board 320 also includes a plurality of conductive paths (not pictured in the figures) that electrically connect the mounted end of each jackwire contact 301-308 to its respective IDC 341-348. Each conductive path may be formed, for example, as a unitary conductive trace that resides on a single layer of the wiring board 320 or as two or more conductive traces that are provided on multiple layers of the wiring board 320 and which are electrically connected through metal-filled vias or other layer transferring techniques known to those of skill in the art. The conductive traces may be formed of conventional conductive materials such as, for example, copper, and are deposited on the wiring board 320 via any deposition method known to those skilled in this art.

The wiring board 320 may further include additional crosstalk compensation elements such as, for example, second stage capacitive crosstalk compensation that may be implemented, for example, as a first inter-digitated finger capacitor that is coupled between the conductive path that connects jackwire contact 303 to IDC 343 and the conductive path that connects jackwire contact 304 to IDC 343. Likewise, additional second stage capacitive crosstalk compensation may be provided in the form of a second inter-digitated finger capacitor that is coupled between the conductive path that connects jackwire contact 305 to IDC 345 and the conductive path that connects jackwire contact 306 to IDC 346.

While FIGS. 11 and 12A-12C illustrate one jack 300 that may be used in the plug-jack connectors according to embodiments of the present invention and in the methods of reducing crosstalk according to embodiments of the present invention, it will be appreciated that many other jacks may be used as well. By way of example, U.S. Pat. No. 6,443,777 to McCurdy et al. and U.S. Pat. No. 6,350,158 to Arnett et al, both disclose jacks having capacitive plates that are coupled to the non-signal current carrying ends of the jackwire contacts of pairs 1 and 3 to provide first stage capacitive crosstalk compensation at the non-signal current carrying ends of the jackwire contacts. Jacks that include such capacitors could be used instead of the jack 300 discussed above. Likewise, in still other embodiments, jacks that have plate capacitors implemented on a printed circuit board that are coupled to the non-signal current carrying ends of the jackwire contacts could be used instead of the inter-digitated finger capacitors 360, 361 that are included in the jack 300. It will be appreciated that other implementations are possible as well, including implementations that use lumped capacitors.

Figure 13:
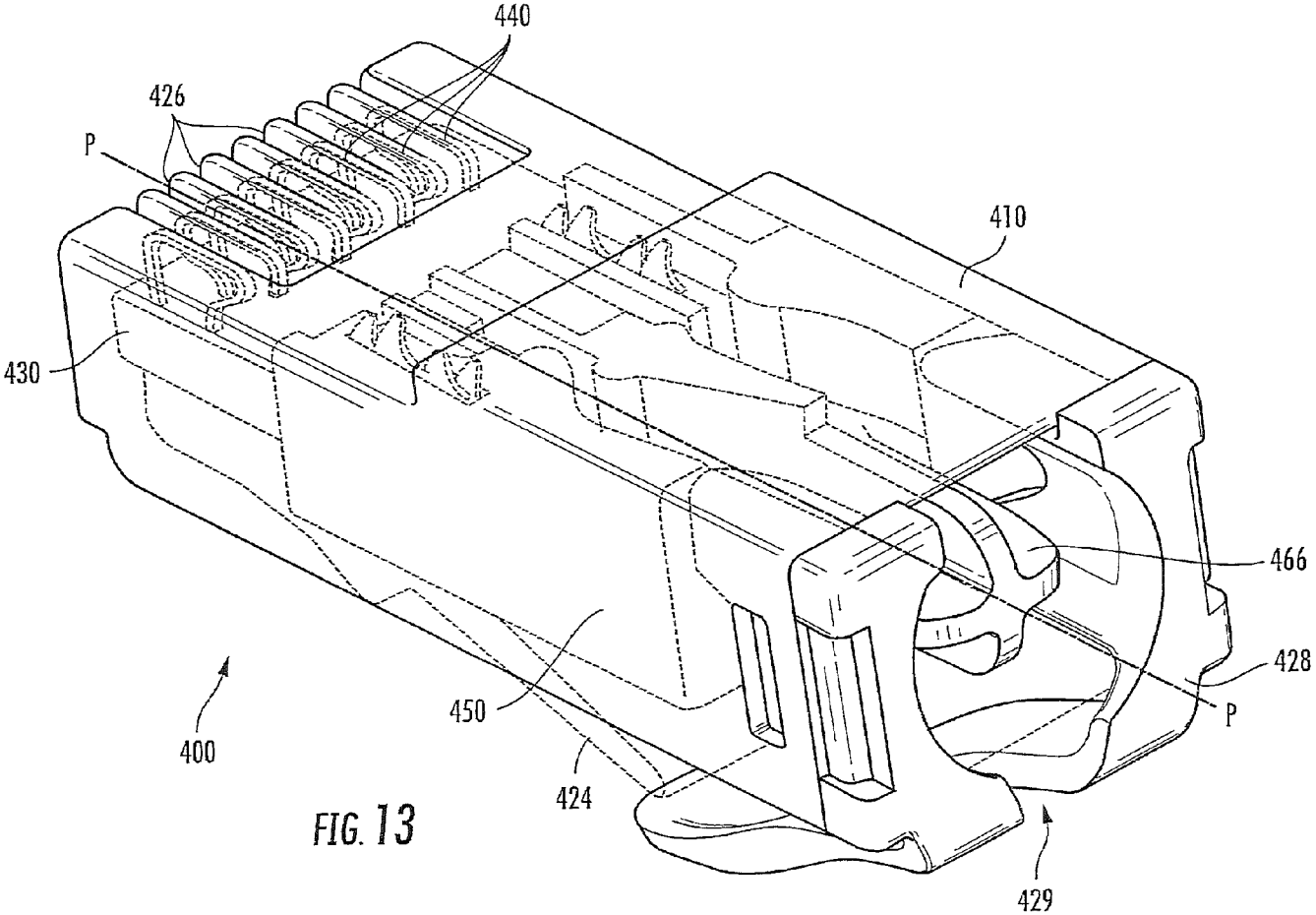
FIG. 13 is a perspective view of a communications plug according to embodiments of the present invention.
Figure 14:
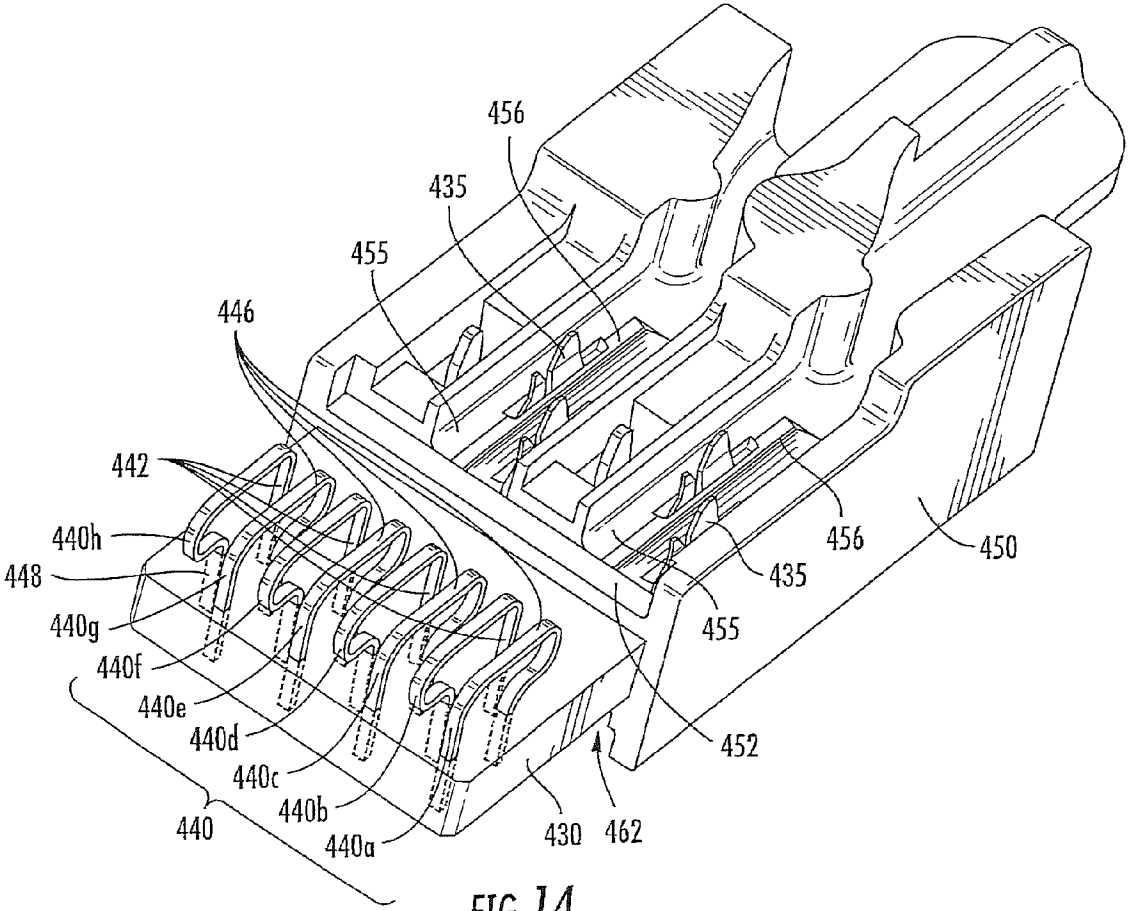
FIG. 14 is a top perspective view of the communications plug of FIG. 13 with the plug housing removed.
Figure 15:
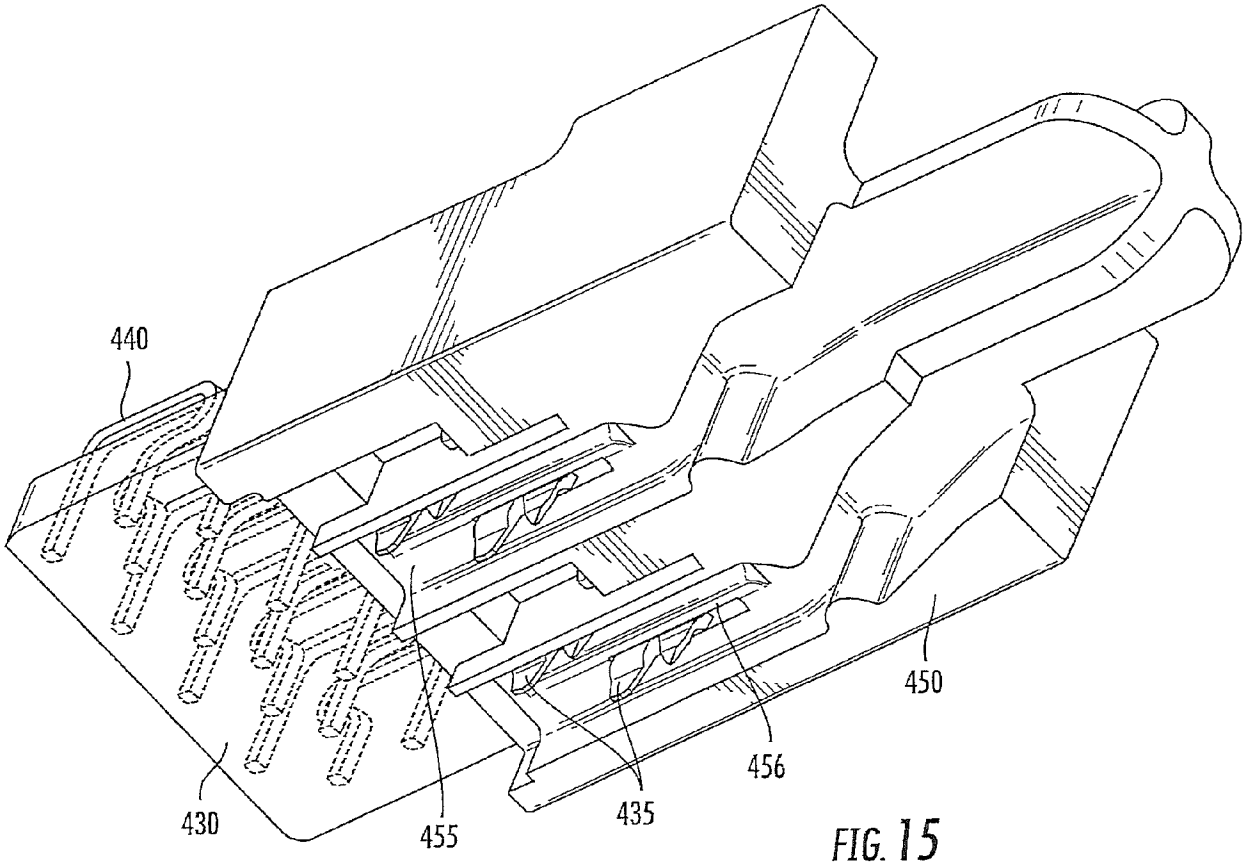
FIG. 15 is a bottom perspective view of the communications plug of FIG. 13 with the plug housing removed.
Figure 16:
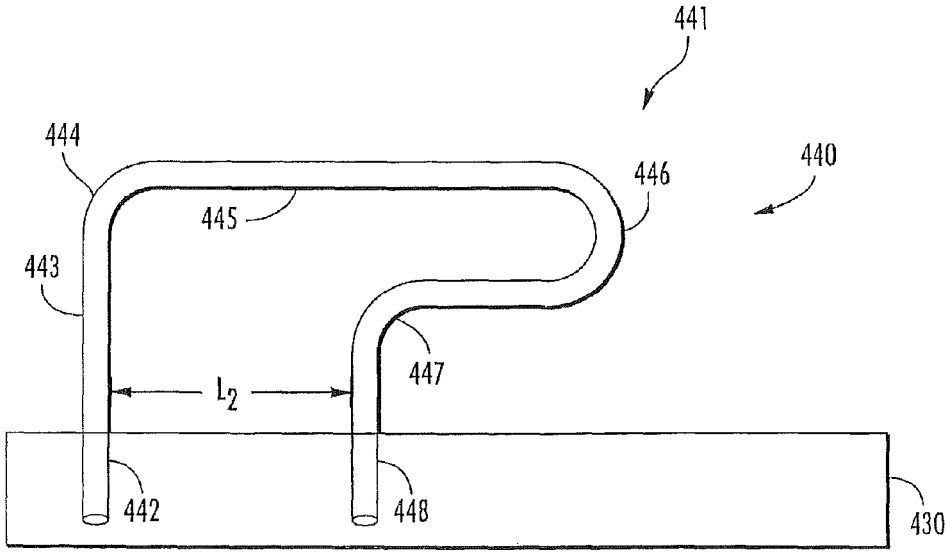
FIG. 16 is a side view of a plug blade of the communications plug of FIG. 13.
Figure 17:
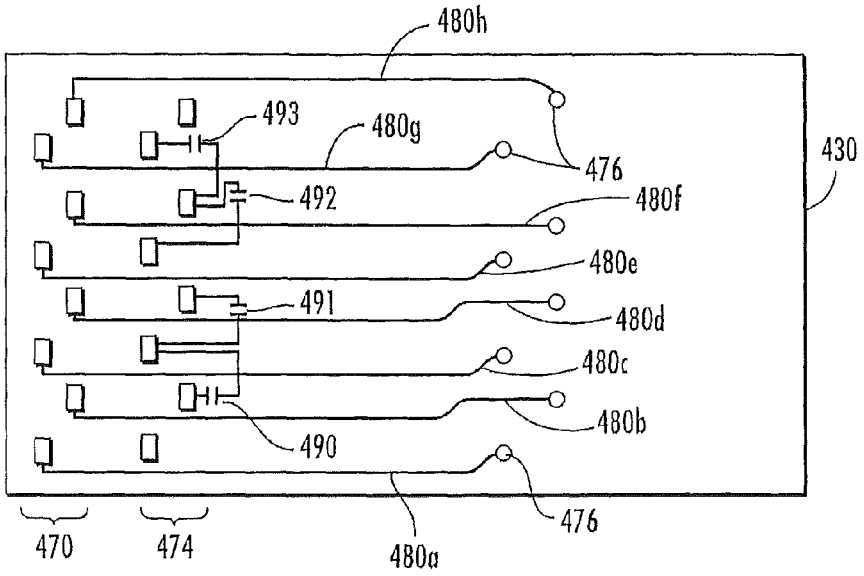
FIG. 17 is a schematic plan view of the printed circuit board of the communications plug of FIG. 13.

FIGS. 13-17 illustrate a communications plug 400 that may be used in the plug-jack connectors according to certain embodiments of the present invention. FIG. 13 is a perspective view of the communications plug 400. FIGS. 14 and 15 are top and bottom perspective views, respectively, of the communications plug 400 with the plug housing 410 removed. FIG. 16 is a side view of one of the plug blades 440 of the communications plug 400. Finally, FIG. 17 is a plan view of a printed circuit 430 of the plug 400. The communications plug 400 is an RJ-45 style modular communications plug.

As shown in FIG. 13, the communications plug 400 includes a housing 410. The housing may be made of conventional materials and may include conventional features of plug housings. The rear face of the housing 410 includes a generally rectangular opening. A plug latch 424 extends from the bottom face of the housing 410. The top and front faces of the housing 410 include a plurality of longitudinally extending slots 426 that expose a plurality of plug contacts or "blades" 440. A separator 466 is positioned within the opening in the rear face of the housing. A jacketed communications cable (not shown) that includes four twisted pairs of insulated conductors may be received through the opening in the rear face of the housing 410 and the jacket may be placed over the separator 466. Each twisted pair of conductors is received within one of the four quadrants of the separator 466. A strain relief mechanism (not shown) such as, for example, a compressible wedge collar, may be received within the interior of the housing 410 such that it surrounds and pinches against the jacketed cable to hold the cable in place against the separator 466. A rear cap 428 that includes a cable aperture 429 locks into place over the rear face of housing 410 after the communications cable has been inserted into the rear face of the housing 410.

As shown best in FIG. 14, a printed circuit board 430 and a board edge termination assembly 450 are each disposed within the housing 410. The board edge termination assembly 450 has an opening 462 in a front surface thereof that receives the rear end of the printed circuit board 430. The printed circuit board 430 may comprise, for example, a conventional printed circuit board, a specialized printed circuit board (e.g., a flexible printed circuit board) or any other type of wiring board. In the pictured embodiment, the printed circuit board 430 comprises a substantially planar multi-layer printed circuit board. Eight plug blades 440 are mounted near the forward top edge of the printed circuit board 430 so that the blades 440 can be accessed through the slots 426 in the top and front faces of the housing 410 (see FIG. 13). In order to distinguish between various of the eight plug blades, the plug blades are individually labeled as 440*a*-440*h* in FIG. 14 and referred to by their individual labels herein where appropriate.

The plug blades 440 are generally aligned in side-by-side fashion in a row. As shown in FIGS. 14 and 16, in one embodiment, each of the eight plug blades 440 may be implemented by mounting a wire 441 into spaced-apart apertures in the printed circuit board 430 to form a "skeletal" plug blade 440. By "skeletal" it is meant that the plug blade 440 has an outer skeleton and a hollow or open area in the center. For example, as shown in FIG. 16, each wire 441 defines an outer perimeter or shell. Thus, in contrast to traditional plug blades for RJ-45 style plugs, each blade 441 has an open interior. The use of such skeletal plug blades 440 may facilitate reducing crosstalk levels between adjacent plug blades 440, thereby reducing, for example, the magnitude of the crosstalk vectors $C_{0C}$, $C'_{0C}$, $D_{0C}$ and $D'_{0C}$ that are discussed above with respect to FIGS. 9A, 9B, 10A and 10B, respectively.

As shown best in FIG. 16, each wire 441 includes a first end 442 that is mounted in a first aperture in the printed circuit board 430, a generally vertical segment 443 that extends from the first end 442, a first transition segment 444 which may be implemented, for example, as a ninety degree bend, a generally horizontal segment 445, a generally U-shaped projection segment 446 which extends from an end of the horizontal segment 445, a second transition segment 447, and a second end 448 that is mounted in a second aperture in the printed circuit board 430. The first and second ends 442, 448 may be soldered or press-fit into their respective apertures in the printed circuit board 430 or mounted by other means known to those of skill in the art.

Each of the plug blades 440 is a planar blade that is positioned parallel to the longitudinal axis P of the plug 400 (see FIG. 13). As shown best in FIG. 14, the U-shaped projection segments 446 on adjacent plug blades 440 point in opposite directions. For example, in FIG. 14, the U-shaped projection 446 on the right-most plug blade 440 points toward the rear of the plug 400, while the U-shaped projection 446 on the next plug blade 440 over points toward the front of the plug 400. As a result, the first ends 442 of the first, third, fifth and seventh wires 441 (counting from right to left in FIG. 14) are aligned in a first row, and the first ends 442 of the second, fourth, sixth and eighth wires 441 (counting from right to left in FIG. 14) are aligned in a second row that is offset from the first row. Similarly, the second ends 448 of the first, third, fifth and seventh wires 441 are aligned in a third row, and the second ends 448 of the second, fourth, sixth and eighth wires 441 are aligned in a fourth row that is offset from the third row. This arrangement may also reduce the magnitude of the crosstalk vectors $C_{0L1}$, $C_{0C}$, $C'_{0L1}$, $C^{0C}$, $D_{0L1}$, $D_{0C}$, $D'_{0L1}$ and $D'_{0C}$ that are discussed above with respect to FIGS. 9A, 9B, 10A and 10B, respectively.

As shown in FIGS. 14 and 15, a plurality of output contacts 435 are mounted at the rear of printed circuit board 430. In the particular embodiment of FIGS. 13-17, a total of eight output contacts 435 are mounted on the printed circuit board 430, with four of the output contacts 435 (see FIG. 14) mounted on the top surface of printed circuit board 430 and the remaining four output contacts 435 (see FIG. 15) mounted on the bottom surface of printed circuit board 430. Each output contact 435 may be implemented, for example, as an insulation piercing contact 435 that includes a pair of sharpened triangular cutting surfaces. The insulation piercing contacts 435 are arranged in pairs, with each pair corresponding to one of the twisted differential pairs of conductors in the communications cable that is connected to plug 400. The insulation piercing contacts 435 of each pair are offset slightly, and the pairs are substantially transversely aligned. This arrangement may facilitate reducing the magnitude of the crosstalk vectors $C_{0C}$, $C'_{0C}$, $D_{0C}$ and $D'_{0C}$ that are discussed above with respect to FIGS. 9A, 9B, 10A and 10B, respectively. It will be appreciated that the output contacts need not be insulation piercing contacts 435. For example, in other embodiments, the output contacts could comprise conventional insulation displacement contacts (IDCs).

The top and bottom surfaces of the board edge termination assembly 450 each have a plurality of generally rounded channels 455 molded therein that each guide a respective one of the eight insulated conductors of the communications cable so as to be in proper alignment for making electrical connection to a respective one of the insulation piercing contacts 435. Each of the insulation piercing contacts 435 extends though a respective opening 456 in one of the channels 455. When an insulated conductor of the cable is pressed against its respective insulation piercing contact 435, the sharpened triangular cutting surfaces pierce the insulation to make physical and electrical contact with the conductor. Each insulation piercing contact 435 includes a pair of base posts (not shown) that are mounted in, for example, metal plated apertures in the printed circuit board 430. At least one of the base posts of each insulation piercing output contact 435 may be electrically connected to a conductive path (see FIG. 17) on the printed circuit board 430.

FIG. 17 is a schematic plan view of the printed circuit board 430 that illustrates the conductive path connections and the crosstalk circuits of one embodiment of the printed circuit board 430. In FIG. 17, conductive paths are indicated by solid lines and capacitors are shown by their conventional circuit symbols. It will be appreciated that the printed circuit board 430 will typically be implemented as a multi-layered printed circuit board 430. On such an actual implementation, each of the conductive paths shown by solid lines in FIG. 17 may, for example, be implemented as one or more conductive traces on one or more layers of the printed circuit board 430 and, as necessary, metal-filled holes that connect conductive traces that reside on different layers. Likewise, each of the capacitive crosstalk circuits shown in FIG. 17 may, for example, be implemented as one or more inter-digitated finger capacitors or plate capacitors (including widened overlapping conductive traces on multiple layers of the printed circuit board that act in effect as capacitors in addition to acting as signal traces). Thus, while FIG. 17 is a schematic diagram that illustrates a functional layout of the printed circuit board 430, it will be appreciated that an actual implementation may look quite different from FIG. 17.

As shown in FIG. 17, the printed circuit board 430 includes eight metal-plated apertures 470 that each hold the end of a respective one of the plug blades 440 that is closest to the front of the printed circuit board 430, and a plurality of metal-plated apertures 474 that each hold the end of a respective one of the plug blades 440 that is closest to the back of the printed circuit board 430. The printed circuit board 430 further includes an additional eight metal-plated apertures 476 that each hold the base post of a respective one of the insulation piercing contacts 435. Eight conductive paths 480 are provided, each of which electrically connects one of the insulation piercing contacts 435 to a respective one of the plug blades 440. In the embodiment of FIG. 17, each conductive path 480*a*-480*h* connects one of the insulation piercing contacts 435 to the end of its respective plug blade that is closest to the front of the printed circuit board 430 (i.e., to the first end 442 of plug blades 440*a*, 440*c*, 440*e* and 440*g*, and to the second end 448 of plug blades 440*b*, 440*d*, 440*f* and 440*h*). As the forward top portion of each plug blade 440 most typically comes into contact with the jackwire contacts of a mating jack, this arrangement may facilitate reducing the amount of the plug blade that is signal current carrying, which may help reduce crosstalk levels in the plug blades 440.

As is further shown in FIG. 17, a plurality of capacitors 490-493 are implemented on various layers of the printed circuit board 430. Each of the capacitors 490-493 is coupled to the non-signal current carrying end of two of the adjacent plug blades 440. Specifically, capacitor 490 is connected between the non-signal current carrying ends of plug blades 440*b* and 440*c*, capacitor 491 is connected between the non-signal current carrying ends of blades 440*c* and 440*d*, capacitor 492 is connected between the non-signal current carrying ends of plug blades 440*e* and 440*f*, and capacitor 493 is connected between the non-signal current carrying ends of blades 440*f* and 440*g*. As is apparent from FIG. 17, each of the capacitors 490-493 inject offending crosstalk. In particular, capacitor 490 injects offending crosstalk between pairs 2 and 3, capacitors 491 and 492 inject offending crosstalk between pairs 1 and 3, and capacitor 493 injects offending crosstalk between pairs 3 and 4. The capacitors 490-493 are "discrete" capacitors in that the electrodes of the capacitor are not part of the plug blades 440, but instead comprise capacitors that are formed of different elements that are coupled between two of the plug blades. It will also be appreciated that, typically, the metal-plated apertures 476 that hold the base posts of the insulation piercing contacts 435 will be arranged in pairs. Thus, in typical implementations, the apertures 476 for conductive paths 480*d*, 480*e* (pair 1) will be mounted next to each other, the apertures 476 for conductive paths 480*a*, 480*b* (pair 2) will be mounted next to each other, the apertures 476 for conductive paths 480*c*, 480*f* (pair 3) will be mounted next to each other, and the apertures 476 for conductive paths 480*g*, 480*h* (pair 4) will be mounted next to each other. The conductive traces 480 will necessarily be rearranged to facilitate such an arrangement of the insulation piercing contacts 435. Such an arrangement of the insulation piercing contacts 435 can be seen, for example, in FIGS. 13-15, where the insulation piercing contacts 435 are mounted in pairs, with the pairs for two of the differential pairs on a top side of the printed circuit board 430 and the pairs of insulation piercing contacts 435 for the remaining two differential pairs on the bottom side of the printed circuit board 430.

The communications plug 400 of FIGS. 13-17 thus includes a plug housing 410 and a plurality of plug contacts

440*a*-440*h* that are each mounted on a printed circuit board to be at least partially within the housing 410. The plug contacts 440*a*-440*h* are implemented as skeletal plug contacts and are configured as a plurality of differential pairs of plug contacts 440*a*, 440*b*; 440*c*, 440*f*; 440*d*, 440*e*; and 440*g*, 440*h*. Each of the plug contacts 440*a*-440*h* has a signal current carrying portion (e.g., segments 442, 443, 444 on plug contacts 440*a*, 440*c*, 440*e*, 440*g* and segments 446, 447, 448 on plug contacts 440*b*, 440*d*, 440*f*, 440*h*) and a non-signal current carrying portion (e.g., segments 446, 447, 448 on plug contacts 440*a*, 440*c*, 440*e*, 440*g* and segments 442, 443, 444 on plug contacts 440*b*, 440*d*, 440*f*, 440*h*). Note that segment 445 on all eight plug contacts 440 will typically include both a signal current carrying portion and a non-signal current carrying portion. Capacitors 490-493 that are implemented as interdigitated finger capacitors within printed circuit board 430 (or as other known printed circuit board capacitor implementations) are coupled between the non-signal current carrying portions of (1) plug contact 440*b* and plug contact 440*c*, (2) plug contact 440*c* and 440*d*, (3) plug contact 440*e* and plug contact 440*f*, and (4) plug contact 440*f* and 440*g*, respectively. Conductive elements (e.g., a small trace on the printed circuit board 430 and/or a metal-plated via through the printed circuit board) may be provided that each connect one of the electrodes of each capacitor 490-493 to the non-signal current carrying portion of a respective one of the plug contacts 440.

The jack 300 and the plug 400 described above may be used to form a plug jack connector 500 according to embodiments of the present invention. Moreover, the crosstalk injected between pairs 1 and 3 in the plug-jack connector 500 may be roughly modeled as comprising the crosstalk vectors illustrated in FIGS. 10A and 10B above. In particular, with respect to the crosstalk between, for example, pairs 1 and 3, the vector $D_{0C2}$ of FIGS. 10A and 10B may be generated by the capacitors 491 and 492 in plug 400, and the vector $D_{1C}$ of FIGS. 10A and 10B may be generated by the capacitors 360 and 361 in the jack 300. As shown in FIGS. 10A and 10B, if the plug capacitors 491, 492 are positioned at the same delay from the plug-jack mating point as the jack capacitors 360, 361, then the vectors $D_{0C2}$ and $D_{1C}$ may be substantially aligned in time. This can provide for improved crosstalk cancellation, as is described above.

Referring again to FIGS. 10A and 10B (which we again assume here shows the crosstalk between pairs 1 and 3), in the plug-jack connector 500 the crosstalk represented by vector $D_{0L1}$ may be generated by (1) the inductive coupling between the conductors of the cable that are electrically connected to plug contacts 440*c* and 440*d* in the region of the rounded channels 455, (2) the inductive coupling between the conductors of the cable that are electrically connected to plug contacts 440*e* and 440*f* in the region of the rounded channels 455, (3) the inductive coupling, if any, between the traces on the printed circuit board 430 that connect to the plug contacts 440*c* and 440*d*, (4) the inductive coupling, if any, between the traces on the printed circuit board 430 that connect to the plug contacts 440*e* and 440*f*, (5) the inductive coupling between the current carrying segments of plug contacts 440*c* and 440*d* and (6) the inductive coupling between the current carrying segments of plug contacts 440*e* and 440*f*. The crosstalk represented by vector $D_{0C1}$ may be generated by the capacitive coupling between plug contacts 440*c* and 440*d* and between plug contacts 440*e* and 440*f*. The crosstalk represented by the vector $D_{0L2}$ may be generated by the inductive coupling between jackwire contacts 303 and 304 and between jackwire contacts 305 and 306 in the region of those jackwire contacts between the plug-jack mating point on those contacts and the crossover 309. The crosstalk represented by the vector $D_{1L}$ may be generated by the inductive coupling between jackwire contacts 303 and 305 and between jackwire contacts 304 and 306 in the region after the crossover 309. Finally, the crosstalk represented by the vector $D_{2C}$ may be generated by the capacitive coupling generated by a capacitor on the wiring board 320 between the conductive paths connected to jackwire contacts 303 and 304 and/or by a capacitor on the wiring board 320 between the conductive paths connected to jackwire contacts 305 and 306 (these capacitors are not depicted in FIG. 12).

As should be apparent from the above discussion, pursuant to embodiments of the present invention, methods of reducing the crosstalk between a first differential pair of conductive paths (e.g., pair 3) and a second differential pair of conductive paths (e.g., pair 1) through a mated plug-jack connection such as the plug-jack connection 500 are provided. Pursuant to these methods, the plug is designed to have a first capacitor that is coupled between one of the conductive paths of the first differential pair of conductive paths (e.g., the conductive path that includes plug contact 440*c*) and one of the conductive paths of the second differential pair of conductive paths (e.g., the conductive path that includes plug contact 440*d*). The jack is designed to have a second capacitor that is coupled between one of the conductive paths of the first differential pair of conductive paths (e.g., the conductive path that electrically connects to plug contact 440*c*) and one of the conductive paths of the second differential pair of conductive paths (e.g., the conductive path that electrically connects to plug contact 440*e*). The plug-jack connector 500 may be designed so that the first capacitor and the second capacitor inject crosstalk from the first differential pair of conductive paths (e.g., pair 3) to the second differential pair of conductive paths (e.g., pair 1) at substantially the same point in time when a signal is transmitted over the first differential pair of conductive paths in the forward direction from the plug to the jack and when a signal is transmitted over the first differential pair of conductive paths in the reverse direction from the jack to the plug.

While not shown in the jack 300 of FIGS. 11 and 12, additional contact pads 372 and 377 may be provided on the wiring board 320 adjacent to contact pads 373 and 376, respectively, that are connected to respective metal-filled vias 372' and 377'. These components may be provided on the wiring board 320 so that a capacitor 362 may be implemented on the wiring board 320 between the non-signal current carrying ends of contact wires 302 and 306, and a capacitor 363 may be implemented on the wiring board 320 between the non-signal current carrying ends of contact wires 303 and 307. The capacitor 362 may generate a vector $D_{1C}$ in graphs such as the graphs of FIGS. 10A and 10B for the crosstalk between pairs 2 and 3. The vector $D_{1C}$ may be substantially aligned in time with the vector $D_{0C2}$ created by the capacitor 490 between plug contacts 440*b* and 440*c*. Similarly, the capacitor 363 may generate a vector $D_{1C}$ in graphs such as the graphs of FIGS. 10A and 10B for the crosstalk between pairs 3 and 4. The vector $D_{1C}$ may be substantially aligned in time with the vector $D_{0C2}$ created by the capacitor 493 between plug contacts 440*f* and 440*g*.

Referring again to FIGS. 10A and 10B, it can be seen that it would be theoretically possible to fully cancel, for example, the near-end crosstalk in the plug by implementing the offending crosstalk in the plug 400 as a single crosstalk circuit that is coupled to the non-signal current carrying ends of the plug blades 440 that injects crosstalk vector $D_{0C2}$, and by implementing a compensating crosstalk vector $D_{1C}$ in the jack 300 at the same point in time and having the same magnitude as vector $D_{0C2}$ and the opposite polarity. However, in practice, this may be difficult to accomplish for several reasons. First, it is difficult to prevent differential coupling between pairs in the current carrying portions of the plug, specifically including the conductors of the cable where they attach to contacts within the plug and in the plug blades, which typically must be positioned according to industry standards in a manner that inherently generates differential crosstalk between the pairs. As such, it may be difficult to concentrate all of the crosstalk between two differential pairs in a single crosstalk vector in either the plug or jack. Second, the applicable industry standards have typically specified ranges for both the NEXT and FEXT that must be generated between each pair combination in the plug. As is known to those of skill in the art, due to the way that inductively and capacitively coupled crosstalk combine differently in the forward and reverse directions, it is typically necessary to have both inductive and capacitive differential coupling in the plug to meet both the NEXT and FEXT standards. Third, it can also be difficult to exactly align the crosstalk generating circuits in the plug and jack exactly in time, and hence there may be residual crosstalk that requires cancellation.

Despite these potential limitations, the crosstalk compensation techniques according to embodiments of the present invention can significantly reduce the crosstalk present in mated communications connectors. By way of example, if two thirds of the crosstalk in the plug is generated at the non-signal current carrying ends of the plug contacts, and if this crosstalk is exactly compensated for in the jack with an equal magnitude crosstalk vector that is aligned in time, then a 10 dB improvement in crosstalk performance may potentially be achieved. Moreover, given that embodiments of the present invention can reduce and/or minimize the difficulties that have arisen in prior art connectors in achieving equal levels of compensation in both the forward and reverse directions, the overall improvement in crosstalk performance may, in some instances, be much higher. Additionally, it may be possible to achieve further improvements in crosstalk performance by locating even a greater percentage of the crosstalk in the plug at the non-signal current carrying ends of the plug blades. Also, related parameters such as return loss may be improved.

Figure 17A:
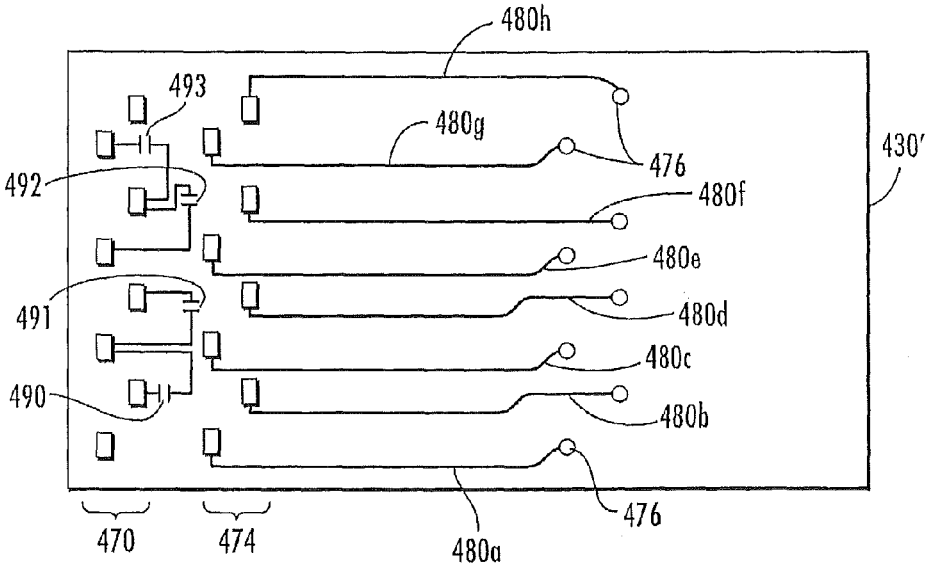
FIG. 17A is a schematic plan view of an alternative printed circuit board for the communications plug of FIG. 13.

It will be appreciated that the above embodiments of the present invention are merely exemplary in nature, and that numerous additional embodiments fall within the scope of the present invention. For example, FIG. 17A is a schematic plan view of an alternative printed circuit board 430' that may be used in the communications plug of FIG. 13. As can be seen by comparing FIGS. 17 and FIG. 17A, the printed circuit board 430' of FIG. 17A is identical to the printed circuit board 430 of FIG. 17, except that in the printed circuit board 430' (1) the capacitors 490-493 are connected to the ends of their respective plug contacts 440*a*-440*h* that is closest to the front of the printed circuit board and (2) the conductive paths 480*a*-480*h* connect to the ends of their respective plug contacts 440*a*-440*h* that are farther removed from the front of the printed circuit board.

Figure 18:
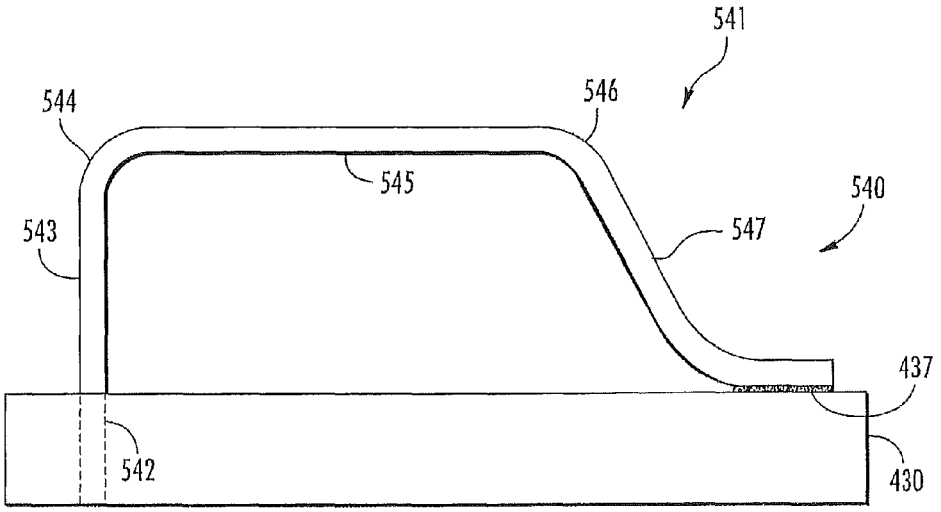
FIG. 18 is a side view of a plug blade according to further embodiments of the present invention.

As another example, FIG. 18 is a side view of a skeletal plug blade 540 according to further embodiments of the present invention that could be used, for example, in the plug 400 of FIGS. 13-17. As shown in FIG. 18, the skeletal plug blade 540 comprises a wire 541 that is shaped similarly to the wire 441 illustrated in FIG. 16. In particular, as shown in FIG. 18, wire 541 includes a first end 542 that is mounted in a first aperture in a printed circuit board 430, a generally vertical segment 543 that is connected to the first end 542, a first transition segment 544 which may be implemented as a generally ninety degree bend, a generally horizontal segment 545, a second transition segment 546 which extends from an end of the generally horizontal segment 545, and a distal end segment 547 which bends toward the top surface of the printed circuit board 430.

As is also shown in FIG. 18, the distal end 547 of wire 541 may mate with a contact pad or other conductive surface 437 on the top surface of the printed circuit board 430. The distal end 547 of wire 541 may form a compression contact with the contact pad 437 when the force exerted by a mating jackwire contact on the wire 541 may exert a force on the distal end 547 that holds the distal end 547 against the contact pad 437. The distal end 547 may also undergo a wiping action against the contact pad 437 when the plug that includes plug blades 540 is inserted into a jack. The contact pad 437 may be connected to conductive traces (not shown) on or within the printed circuit board 430. The first end 542 of wire 541 may be press-fit into its aperture in the printed circuit board 430 or mounted in the printed circuit board 430 by other means known to those of skill in the art. It will also be appreciated that, in some embodiments, neither end of the wire 541 may be mounted in the printed circuit board 430, and instead one or more contact pad connections or other similar connections may be used to electrically connect the wire 541 to conductive elements on and/or within the printed circuit board 430.

Some or all of the eight plug blades in the plug 400 of FIGS. 13-17 may, in some embodiments, be implemented using the plug blade 540. The plug blades 540 may be arranged in a side-by-side relationship to provide a row of plug blades. Each of the plug blades 540 may be positioned parallel to the longitudinal axis P of the plug 400 (see FIG. 13). Moreover, as discussed above with respect to the embodiment of FIGS. 13-17, adjacent of the plug blades 540 may be mounted to extend in opposite directions. Thus, the distal ends 547 of adjacent plug blades 540 may be generally parallel to each other, but be offset from each other along the longitudinal axis P and point in opposite directions.

Pursuant to still further embodiments of the present invention, capacitors may be provided in either or both a communications plug and/or a communications jack in which one electrode of the capacitor is connected to the non-signal current carrying end of one of the plug blades or jackwire contacts, while the other electrode of the capacitor is connected to the signal current carrying end of another of the plug blades or jackwire contacts. By way of example, FIG. 19 illustrates a printed circuit board 431 which may be used in the plug 400 of FIGS. 13-17 in place of the printed circuit board 430.

Figure 19:
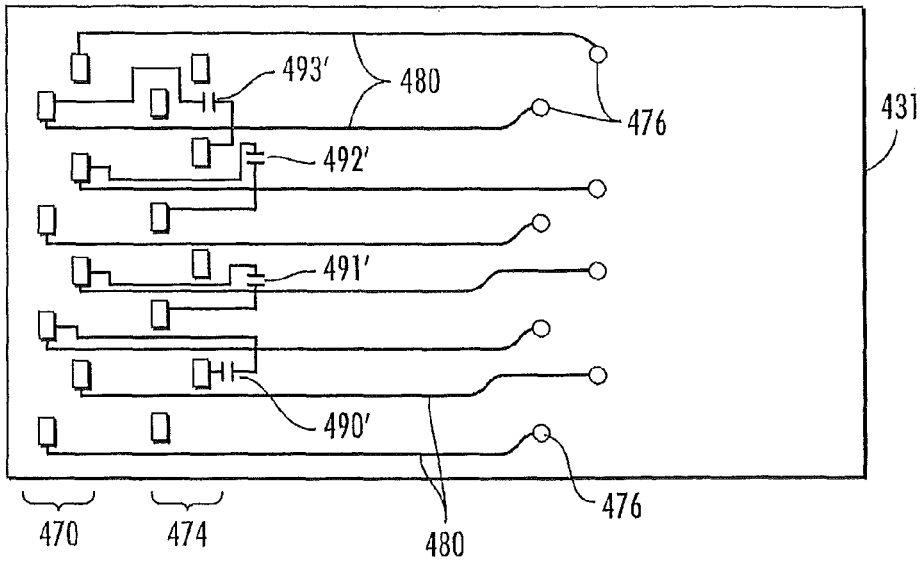
FIG. 19 is a schematic plan view of another printed circuit board that may be used in the communications plug of FIG. 13.

As shown in FIG. 19, the printed circuit board 431 may be almost identical to the printed circuit board 430, except that the capacitors 490-493 are replaced with capacitors 490'-493'. Capacitor 490' is connected between the non-signal current carrying end of blade 440*b* and the signal current carrying end of blade 440*c*, capacitor 491' is connected between the non-signal current carrying end of blade 440*c* and the signal current carrying end of blade 440*d*, capacitor 492' is connected between the non-signal current carrying end of blade 440*e* and the signal current carrying end of blade 440*f*, and capacitor 493' is connected between the non-signal current carrying end of blade 440*f* and the signal current carrying end of blade 440*g*. By coupling a first of the electrodes of each capacitor 490'-493' to a non-signal current carrying end of one of the plug blades and the second electrode of each capacitor 490'-493' to a signal current carrying end of a respective one of the plug blades, the crosstalk vector that corresponds to each capacitor moves to the left in FIG. 10A and also may become distributed over time.

Figure 20:
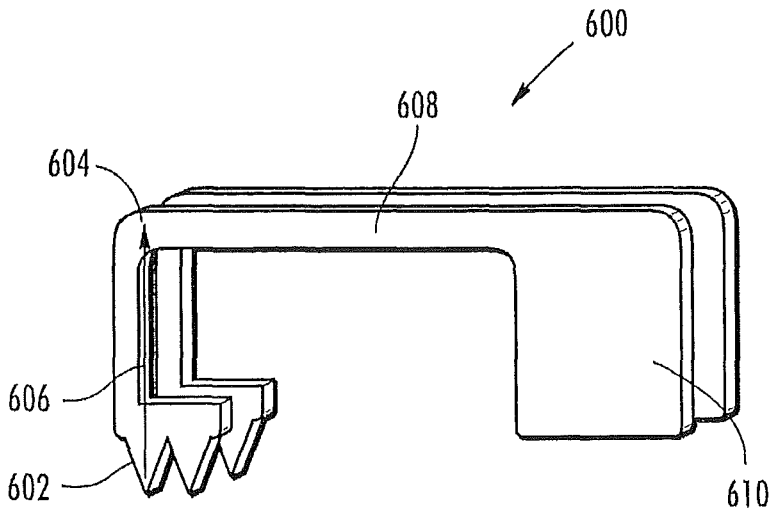
FIG. 20 is a perspective view of two plug blades according to further embodiments of the present invention.

Pursuant to still additional embodiments of the present invention, communications plugs may be provided (as well as plug-jack connectors that include such plugs) which have plug blades that have both signal current carrying and non-signal current carrying portions, and which implement plate (or other type) capacitors in the non-signal current carrying portion of the plug blade. FIG. 20 is a perspective view of two such plug blades 600. As shown in FIG. 20, each of the plug blades 600 includes a wire connection terminal 602 (which is implemented in this embodiment as an insulation piercing contact), a jackwire contact area 604, a signal current carrying region 606, a thin extension 608 and a plate capacitor region 610. The jackwire contact area 604 is the arcuate region that comprises the top forward portion of the blade 600. For signals traveling in the forward direction, the signal is injected into the plug blade 600 at the wire connection terminal 602 where it is received from its associated conductor in a communication cable. The signal travels from the wire connection terminal 602 through the signal current carrying region 606 to the jackwire contact area 604, where the signal is transferred to the jackwire contact of a jack.

As shown by the arrow in FIG. 20 which represent the flow of the signal current (for signals travelling in the forward direction from the plug to the jack), given the location of the thin extension 608 well off to one side of the shortest path between the wire connection terminal 602 and the jackwire contact area 604 and the shape of the thin extension 608, the signal current that flows through the connector does not generally flow through either the extension area 608 or to the plate capacitor region 610 on its way through the plug blade 600. As a result, the plate capacitor region 610 of each plug blade 600 comprises a non-signal current carrying portion of the plug blade, and thus the offending crosstalk that is generated by coupling between the plate capacitor regions 610 of adjacent plug blades will appear on the jack side of the plug-jack contact point in a graph of the crosstalk versus time such as the graphs of FIGS. 10A and 10B. Thus, the plug blades 600 illustrate an alternative method of providing capacitive coupling at the non-signal current carrying ends of plug blades (or jackwire contacts) other than the printed circuit board implemented inter-digitated finger and/or plate capacitors discussed above. It will be appreciated that numerous additional plug blade designs are possible that include capacitive coupling regions in a non-signal current carrying portion of the plug blade.

Figure 21:
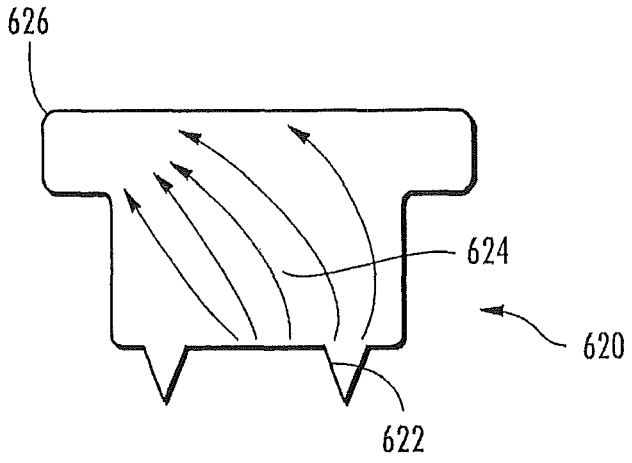
FIG. 21 (PRIOR ART)
FIG. 21 is a side view of a conventional plug blade that illustrates the signal current path through the plug blade.

FIG. 21 depicts a conventional plug blade 620. As shown in FIG. 21, the conventional plug blade 620 includes a wire connection terminal 622 that is attached to a wide blade region 624 that includes a jackwire contact region 626 at the top forward portion thereof. While a signal injected into the plug blade 620 will flow most heavily along a shortest path between the wire connection terminal 622 and the jackwire contact region 626, the signal current will generally spread throughout the wide blade region 624 as it flows between the wire connection terminal 622 and the jackwire contact region 626. Thus, as shown by the arrows in FIG. 21, the signal current spreads throughout substantially the whole plug blade, and the capacitive coupling that occurs between adjacent plug blades of a conventional plug thus occurs in a signal current carrying region of the plug blade. As a result, the offending crosstalk that is generated by coupling between the wide blade regions 624 of adjacent plug blades will appear on the plug side of the plug-jack contact point in a graph of the crosstalk versus time, as shown, for example, in FIGS. 9A and 9B.

Figure 22:
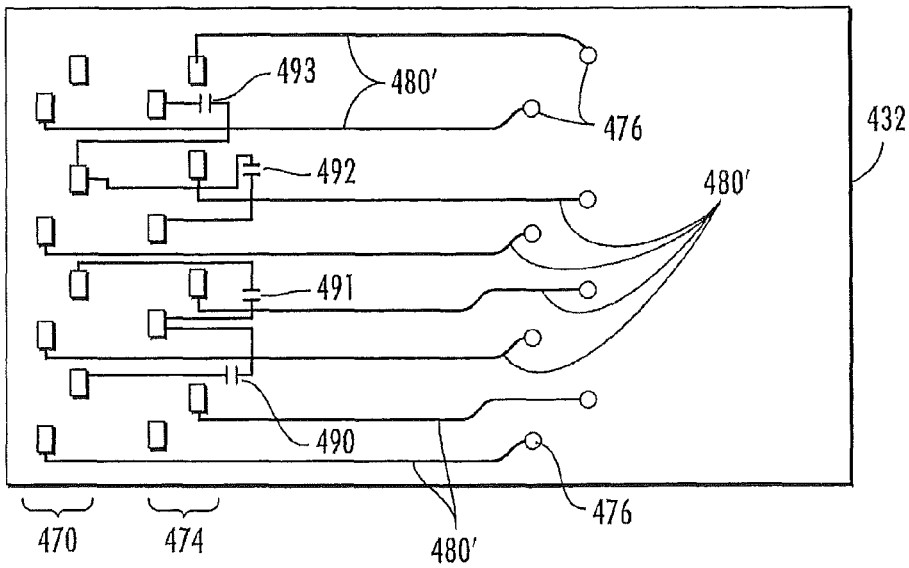
FIG. 22 is a schematic plan view of yet another printed circuit board that may be used in the communications plug of FIG. 13.

Pursuant to still further embodiments of the present invention, the plug 400 discussed above may be modified to further reduce inductive coupling between adjacent of the plug blades 440. FIG. 22 is a schematic plan view of a modified printed circuit board 432 that could be used to implement this concept in the plug 400.

As shown in FIG. 22, the printed circuit board 432 includes eight metal-plated apertures 470 that each hold the end of a respective one of the plug blades 440 that is closest to the front of the printed circuit board 432, and a plurality of metal-plated apertures 474 that each hold the end of a respective one of the plug blades 440 that is closest to the back of the printed circuit board 432. The printed circuit board 432 further includes an additional eight metal-plated apertures 476 that hold the respective insulation piercing contacts 435. A plurality of conductive paths 480' electrically connect each of the metal-plated apertures 476 to a respective one of the plug blades 440. In the embodiment of FIG. 22, the conductive paths 480' for plug blades 440*a*, 440*c*, 440*e* and 440*g* connect to a respective one of the metal-plated apertures 470, while the conductive paths 480 for plug blades 440*b*, 440*d*, 440*f* and 440*h* connect to a respective one of the metal-plated apertures 474. As a result, the current flows in plug blades 440*a*, 440*c*, 440*e* and 440*g* in a direction from the front toward the back of the plug blade, while the current flows in plug blades 440*b*, 440*d*, 440*f* and 440*h* in a direction from the back toward the front of the plug blade. Since the currents flow through different parts of adjacent plug blades, there is less inductive coupling between adjacent plug blades, which in turn decreases the magnitude of crosstalk vector $D_{0L1}$ in FIGS. 10A and 10B. As is further shown in FIG. 22, the connections for inter-digitated finger capacitors 490-493 have been modified in the embodiment of FIG. 22 (as compared to the embodiment of FIG. 17) so that each capacitor is connected to the non-current carrying end of its respective plug blades. It should also be recognized that other mixed combinations of the point of attachment for the conductive paths 480, 480' to the metal-plated apertures 470, 474 may be useful for finely matching delay positions of the offending crosstalk. Thus, it will be appreciated that, in further embodiments of the present invention, FIG. 22 could be modified so that any or all of the conductive paths 480' that connect to the metal-plated apertures 474 of their respective plug blade could instead connect to the metal-plated aperture 470, and/or any or all of the conductive paths 480' that connect to the metal-plated apertures 470 of their respective plug blade could instead connect to the metal-plated aperture 474. Furthermore it should also be recognized that distal ends with coupling also develop signal reflections, and while signal reflections generally degrade signal transmission, the options for mixed combinations can provide suitable choices for optimizing reflection effects as well.

As discussed above, pursuant to embodiments of the present invention, offending crosstalk that is generated in the plug and compensating crosstalk that is generated in the jack of a mated plug-jack connector may be substantially aligned in time so as to achieve a high degree of crosstalk cancellation. One method of achieving this, discussed above, is to use capacitors that are connected to the non-signal current carrying ends of the plug blades and/or jackwire contacts. Pursuant to further embodiments of the present invention, crosstalk in the jack and plug may be substantially aligned in time by reactively coupling a first conductive element in the plug with a second conductive element in the jack.

Figure 23:
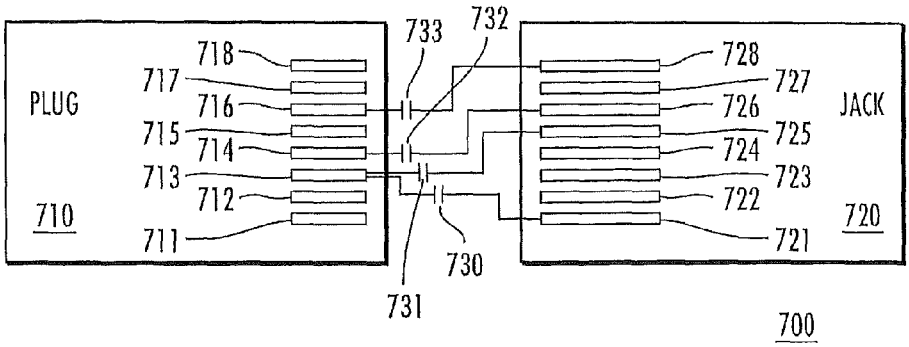
FIG. 23 is a schematic diagram of a plug-jack connector according to further embodiments of the present invention

This concept is illustrated with respect to FIG. 23, which is a schematic diagram of a plug-jack connector 700 according to further embodiments of the present invention that includes an RJ-45 plug 710 and an RJ-45 jack 720. As shown in FIG. 23, the plug 710 includes plug contacts 711-718 that are arranged according to the TIA 568B wiring configuration, and the jack 720 includes jackwire contacts 721-728 that are likewise arranged according to the TIA 568B wiring configuration. Four capacitors 730-733 are also provided. The capacitor 730 has a first electrode that is coupled to plug blade 713 and a second electrode that is coupled to jackwire contact 721. This capacitor 730 injects a compensating crosstalk signal between pairs 2 and 3 that may compensate, for example, offending crosstalk generated in the plug 710 between plug blades 712 and 713. As the capacitor is formed between a plug blade and a jackwire contact, the location of the compensating crosstalk vector generated by capacitor 730 is generally moved to the left on a plot of crosstalk versus time such as graphs FIG. 10A and/or 10B, and may be designed to be, for example, on the plug side of the plug-jack mating point.

As is further shown in FIG. 23, the capacitor 731 has a first electrode that is coupled to plug blade 713 and a second electrode that is coupled to jackwire contact 725. The capacitor 732 has a first electrode that is coupled to plug blade 714 and a second electrode that is coupled to jackwire contact 726. These capacitors 731-732 inject a compensating crosstalk signal between pairs 1 and 3 that may compensate, for example, offending crosstalk generated in the plug 710 between plug blades 713 and 714 and between plug blades 715 and 716. The capacitor 733 has a first electrode that is coupled to plug blade 716 and a second electrode that is coupled to jackwire contact 728. This capacitor 734 injects a compensating crosstalk signal between pairs 3 and 4 that may compensate, for example, offending crosstalk generated in the plug 710 between plug blades 716 and 717. As with capacitor 730, the capacitors 731-733 may be designed to so that the compensating crosstalk vector that they generate is, for example, on the plug side of the plug-jack mating point.

Figure 24:
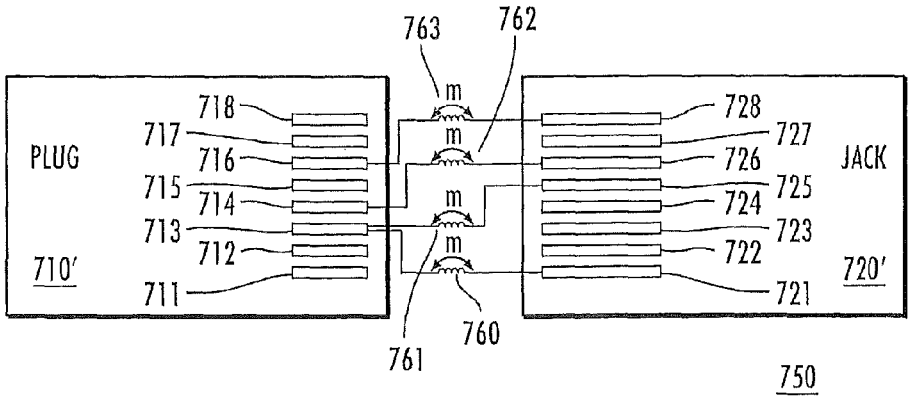
FIG. 24 is a schematic diagram of a plug-jack connector according to still further embodiments of the present invention

Another method of substantially aligning the crosstalk vectors associated with offending crosstalk that is generated in the plug and compensating crosstalk that is generated in the jack of a mated plug-jack connector according to still further embodiments of the present invention is to implement the compensating crosstalk by inductively coupling a current path in the jack with a current path in the plug. This method is illustrated schematically in FIG. 24, which illustrates a plug-jack connector 750. FIG. 24 is almost identical to FIG. 23, except that the capacitors 730-733 are replaced with inductive coupling circuits 760-763 which provide inductive crosstalk compensation instead of capacitive crosstalk compensation. Such inductive coupling circuits may be implemented, for example, by routing one of the conductive paths through the jack to pass immediately above (or below, depending upon the orientation of the plug-jack connector 750) the plug blade that it is to inductively couple with (as known to those of skill in the art, each such inductive coupling circuit results in mutual inductance between the two conductive paths). For example, a printed circuit board could be mounted in the jack frame of jack 720', where the printed circuit board is immediately adjacent to the eight plug blades when the plug 710' is inserted into the jackframe. If the conductive paths through the jack 720' are routed through such a printed circuit board, some of the conductive paths may be arranged to be longitudinally aligned with respective ones of the plug blades and to run directly above these plug blades, thereby creating an inductive coupling circuit between each plug blade and respective ones of the conductive paths in the jack 720'. While this is one possible way of implementing such a circuit, it will be appreciated that numerous other ways are also possible.

Figure 25:
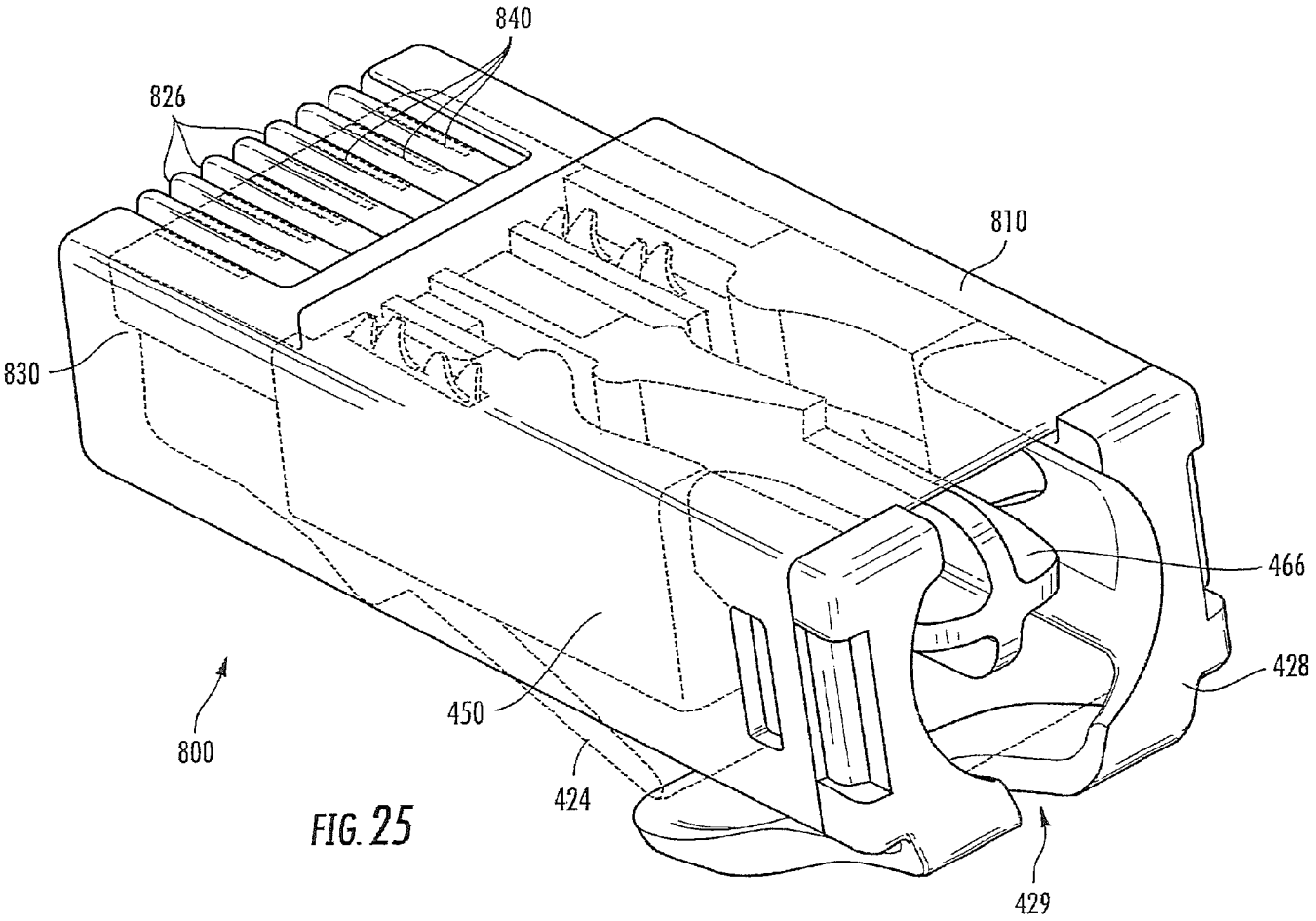
FIG. 25 is a schematic perspective diagram of a communications plug according to still further embodiments of the present invention.

FIG. 25 is a perspective schematic diagram of a communications plug 800 according to further embodiments of the present invention. As shown in FIG. 25, the plug 800 includes a plug housing 810 and a printed circuit board 830. The plug contacts 840 are implemented as contact pads that are disposed on the top and front surface of the printed circuit board 840 instead of, for example, the skeletal plug blades 440 of the plug 400 of FIGS. 13-17 (note that only the top portion of the contact pads are visible in FIG. 25). Since the plug 800 may be substantially identical to the plug 400 of FIGS. 13-17 aside from the use of contact pad plug contacts instead of skeletal plug blades and the change in the shape of the housing 810, further description of the various parts of plug 800 will be omitted here. Note that due to the use of contact pad plug blades, capacitive coupling between adjacent plug blades may be very minimal. This can facilitate providing a plug design where substantially all of the capacitive coupling between adjacent plug blades is provided by capacitors such as the capacitors 490-493 of the plug 400 (see FIG. 17). The plug 800 may also be less expensive to manufacture than the plug 400.

Various of the embodiments of the present invention discussed above have provided a first capacitor between plug contacts 2 and 3 and a second capacitor between plug contacts 6 and 7 (as well as additional capacitors), where the plug contacts are numbered according to the TIA 568 B wiring convention as shown in FIG. 2 above. It will be appreciated, however, that the same effect may be obtained by placing these capacitors between the other conductors of the differential pairs at issue. By way of example, the first capacitor that is provided between plug contacts 2 and 3 in various of the embodiments discussed above (e.g., capacitor 490 in FIG. 17) could be replaced with a capacitor that is provided between plug contacts 1 and 6. Similarly, the second capacitor that is provided between plug contacts 6 and 7 in various of the embodiments discussed above (e.g., capacitor 493 in FIG. 17) could be replaced with a capacitor that is provided between plug contacts 3 and 8. Such an arrangement may also advantageously reduce mode conversion.

Note that in the claims appended hereto, references to "each" of a plurality of objects (e.g., plug blades) refers to each of the objects that are positively recited in the claim. Thus, if, for example, a claim positively recites first and second of such objects and states that "each" of these objects has a certain feature, the reference to "each" refers to the first and second objects recited in the claim, and the addition of a third object that does not include the feature is still covered by the claim.

While embodiments of the present invention have primarily been discussed herein with respect to communications plugs and jacks that include eight conductive paths that are arranged as four differential pairs of conductive paths, it will be appreciated that the concepts described herein are equally applicable to connectors that include other numbers of differential pairs. It will also be appreciated that communications cables and connectors may sometimes include additional conductive paths that are used for other purposes such as, for example, providing intelligent patching capabilities. The concepts described herein are equally applicable for use with such communications cables and connectors, and the addition of one or more conductive paths for providing such intelligent patching capabilities or other functionality does not take such cables and connectors outside of the scope of the present invention or the claims appended hereto.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A patch cord, comprising:

a communications cable;

an RJ-45 communications plug that is attached to the communications cable, the communications plug comprising:

a housing including a plurality of longitudinally extending slots;

a printed circuit board that is at least partly within the housing;

first through eighth contact pads on the printed circuit board that are arranged in a row in numerical order, wherein the fourth and fifth contact pads comprise a first differential pair of contact pads, the first and second contact pads comprise a second differential pair of contact pads, the third and sixth contact pads comprise a third differential pair of contact pads, and the seventh and eighth contact pads comprise a fourth differential pair of contact pads, wherein each of the first through eighth contact pads is exposed through a respective one of the plurality of longitudinally extending slots, and wherein the printed circuit board includes an offending crosstalk injection circuit.

2. The patch cord of claim 1, wherein the offending crosstalk injection circuit injects offending crosstalk between the second pair of contact pads and the third pair of contact pads.

3. The patch cord of claim 2, wherein the offending crosstalk injection circuit comprises a capacitor that is electrically connected between the first plug contact and the sixth plug contact.

4. The patch cord of claim 3, wherein the printed circuit board comprises a flexible printed circuit board.

5. The patch cord of claim 3, further comprising a second capacitor on the printed circuit board that is electrically connected between the third contact pad and the eighth contact pad.

6. The patch cord of claim 3, further comprising a first plurality of wire termination contacts that are mounted to extend from a top surface of the printed circuit board and a second plurality of wire termination contacts that are mounted to extend from the bottom surface of the printed circuit board.

7. The patch cord of claim 3, wherein each contact pad extends along a top surface on the printed circuit board, and wherein each of the contact pads also extends along a front edge of the printed circuit board that is opposite an end of the communications plug that receives the communications cable.

8. A communications patch cord that includes a communications cable that includes first through eighth insulated conductors that are arranged as four twisted pairs of conductors and a communications plug that is attached to the communications cable, the communications plug comprising:

a housing;

a flexible printed circuit board that is at least partly within the housing, the flexible printed circuit board including first through eighth conductive paths that are electrically connected to respective ones of the first through eighth insulated conductors to provide four pairs of conductive paths;

first through eighth plug contacts that are positioned in numerical order on the flexible printed circuit board and that are electrically connected to respective ones of the first through eighth conductive paths on the flexible printed circuit board, wherein the fourth and fifth plug contacts comprise a first differential pair of plug contacts, the first and second plug contacts comprise a second differential pair of plug contacts, the third and sixth plug contacts comprise a third differential pair of plug contacts, and the seventh and eighth plug contacts comprise a fourth differential pair of plug contacts; and an offending crosstalk injection circuit on the flexible printed circuit board.

9. The communications plug of claim 8, wherein the offending crosstalk injection circuit injects offending crosstalk between the second pair of plug contacts and the third pair of plug contacts.

10. The communications plug of claim 9, wherein the offending crosstalk injection circuit comprises a capacitor that is electrically connected between the first plug contact and the sixth plug contact.

11. The communications plug of claim 10, wherein the flexible printed circuit board includes a second capacitor that is electrically connected between the third plug contact and the eighth plug contact.

12. The communications plug of claim 9, wherein the flexible printed circuit board includes a plurality of mounting apertures for the first through eighth plug contacts, and wherein the mounting aperture for one of the plug contacts is longitudinally offset from the mounting aperture for another of the plug contacts.

13. The communications plug of claim 8, wherein each of the plug contacts comprises a contact pad on the flexible printed circuit board, and wherein the housing includes a plurality of longitudinally extending slots that expose the respective contact pads.

14. A communications plug, comprising:

a housing;

first through eighth input contacts that are generally aligned in a row in numerical order;

first through eighth output contacts;

a printed circuit board that is at least partly within the housing, the printed circuit board including first through eighth conductive paths that electrically connect the first through eighth input contacts to the respective first through eighth output contacts;

a first capacitor that is electrically connected between the first conductive path and the sixth conductive path or between the second conductive path and the third conductive path.

15. The communications plug of claim 14, further comprising a second capacitor that is electrically connected between the third conductive path and the eighth conductive path or between the sixth conductive path and the seventh conductive path.

16. The communications plug of claim 15, wherein the first through eighth input contacts comprise first through eighth plug blades that are mounted in respective ones of first through eighth conductive apertures in the printed circuit board.

17. The communications plug of claim 16, wherein the first through first through eighth plug blades comprise first through eighth wires that each have a first end mounted in a respective one of the conductive apertures.

18. The communications plug of claim 16, wherein the third conductive aperture is longitudinally staggered with respect to the fourth conductive aperture.

* * * * *

UNITED STATES PATENT AND TRADEMARK OFFICE

CERTIFICATE OF CORRECTION

PATENT NO. : 9,190,777 B2
APPLICATION NO. : 14/198821
DATED : November 17, 2015
INVENTOR(S) : Larsen et al.

It is certified that error appears in the above-identified patent and that said Letters Patent is hereby corrected as shown below:

In the specification,
Column 5, Line 36: Please correct "□" to read -- φ --
Column 5, Line 38: Please correct "□" to read -- φ --
Column 5, Line 39: Please correct "□" to read -- φ --
Column 5, Line 44: Please correct "as cp gets" to read -- as φ gets --
Column 25, Line 4: Please correct "$C^{OC}$," to read -- $C'_{0C}$, --

Signed and Sealed this
Third Day of May, 2016

Michelle K. Lee

Michelle K. Lee
*Director of the United States Patent and Trademark Office*